US011771231B1

(12) United States Patent
Wang

(10) Patent No.: US 11,771,231 B1
(45) **Date of Patent: *Oct. 3, 2023**

(54) MULTIFUNCTIONAL CHAIR

(71) Applicant: NAN YA PLASTICS CORPORATION, Taipei (TW)

(72) Inventor: Kuei-Yung Wang, Taipei (TW)

(73) Assignee: NAN YA PLASTICS CORPORATION, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 18/120,984

(22) Filed: Mar. 13, 2023

(30) Foreign Application Priority Data

May 9, 2022 (TW) ..... 111204731
Jan. 31, 2023 (TW) ..... 112200837

(51) Int. Cl.
*A47C 9/00* (2006.01)
*A63B 21/16* (2006.01)
*A63B 21/00* (2006.01)
*A63B 21/04* (2006.01)

(52) U.S. Cl.
CPC ..... *A47C 9/002* (2013.01); *A63B 21/0421* (2013.01); *A63B 21/1609* (2015.10); *A63B 21/4047* (2015.10); *A63B 2208/0233* (2013.01)

(58) Field of Classification Search
CPC . A47C 9/002; A63B 21/1609; A63B 21/4047; A63B 21/0421; A63B 2208/0233
See application file for complete search history.

(56) References Cited

U.S. PATENT DOCUMENTS 5,044,633 A 9/1991 Rice
6,634,997 B2 10/2003 Breibart
7,128,700 B2 * 10/2006 Wallach ..... A63B 21/4011 482/121
7,445,586 B2 11/2008 Gibson
7,794,378 B2 * 9/2010 Splane, Jr. ..... A63B 21/02 482/148
8,007,423 B2 * 8/2011 Solow ..... A63B 23/03525 482/148
8,613,692 B2 12/2013 Baudhuin
9,533,190 B2 * 1/2017 Walkama ..... A63B 26/00
9,573,012 B1 * 2/2017 Lee ..... A63B 23/0222
11,324,990 B2 5/2022 Clark et al.
11,547,895 B1 * 1/2023 Wang ..... A47C 9/002
(Continued)

*Primary Examiner* — Philip F Gabler
(74) *Attorney, Agent, or Firm* — Li & Cai Intellectual Property Office

(57) ABSTRACT

A multifunctional chair includes a support body, a telescopic structure, a seat body and a pedal assembly. The pedal assembly includes a fixing rod, a movable rod, an operating element and an elastic resistance element. The telescopic structure is connected with the support body, and the telescopic structure can be operated to move telescopically relative to the support body. One end of the fixing rod is fixed to the support body. The movable rod is movably connected with the fixing rod. The operating element is located at the end of the movable rod. Two ends of the elastic resistance element are respectively connected to the support body and the fixing rod. When the movable rod and the fixing rod are rotated toward the ground by pressing the operating element, the elastic resistance element can provide elastic resistance accordingly, so that the user can perform related muscle training exercises.

8 Claims, 24 Drawing Sheets

(56) References Cited

U.S. PATENT DOCUMENTS

| | | | | |
|---|---|---|---|---|
| 2007/0037677 | A1 | 2/2007 | Splane, Jr. | |
| 2009/0197746 | A1 | 8/2009 | Splane, Jr. et al. | |
| 2009/0264266 | A1 | 10/2009 | Solow et al. | |
| 2016/0037925 | A1* | 2/2016 | Yen | A63B 21/068 297/325 |

* cited by examiner

MULTIFUNCTIONAL CHAIR

CROSS-REFERENCE TO RELATED PATENT APPLICATION

This application claims the benefit of priorities to Taiwan Patent Application No. 111204731, filed on May 9, 2022, and No. 112200837, filed on Jan. 31, 2023. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a multifunctional chair, and more particularly to a multifunctional chair that allows a user to exercise thereon.

BACKGROUND OF THE DISCLOSURE

In the related art, conventional office chairs do not allow a user to exercise thereon.

SUMMARY OF THE DISCLOSURE

In response to the above-referenced technical inadequacy, the present disclosure provides a multifunctional chair, which is mainly used to improve the conventional office chairs that cannot provide exercise functions for users.

In order to solve the above-mentioned problems, one of the technical aspects adopted by the present disclosure is to provide a multifunctional chair, which includes a support body, a seat body and at least one pedal assembly. The support body includes a placing part configured to be placed on a ground. The seat body is fixed to a fixed part of the support body. The at least one pedal assembly includes at least one fixing rod, at least one operating element and at least one elastic resistance element. One end of the at least one fixing rod is pivotally connected to the support body. The at least one operating element is pivotally connected to another end of the at least one fixing rod, and the operating element is configured to be rotated relative to the at least one fixing rod and switched between a storage position and a support position; wherein, when the operating element is configured to be located at the storage position, the operating element does not protrude from a front edge of the seat body; wherein, when the operating element is configured to be located at the support position, the operating element and the at least one fixing rod are engaged with each other, and the operating element protrudes from the front edge of the seat body. Two ends of the at least one elastic resistance element are respectively fixed to the support body and the at least one fixing rod. The operating element located at the support position is configured to be operated to make the at least one fixing rod rotate relative to the support body, so that the elastic resistance element is configured to provide an elastic resistance. The operating element located at the support position is configured to be pressed by feet, a left hand or a right hand of a user sitting on the seat body.

To sum up, through the support body and the pedal assembly, the multifunctional chair provided by the present disclosure is not only used as an office chair, but also allows users to exercise on the multifunctional chair.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
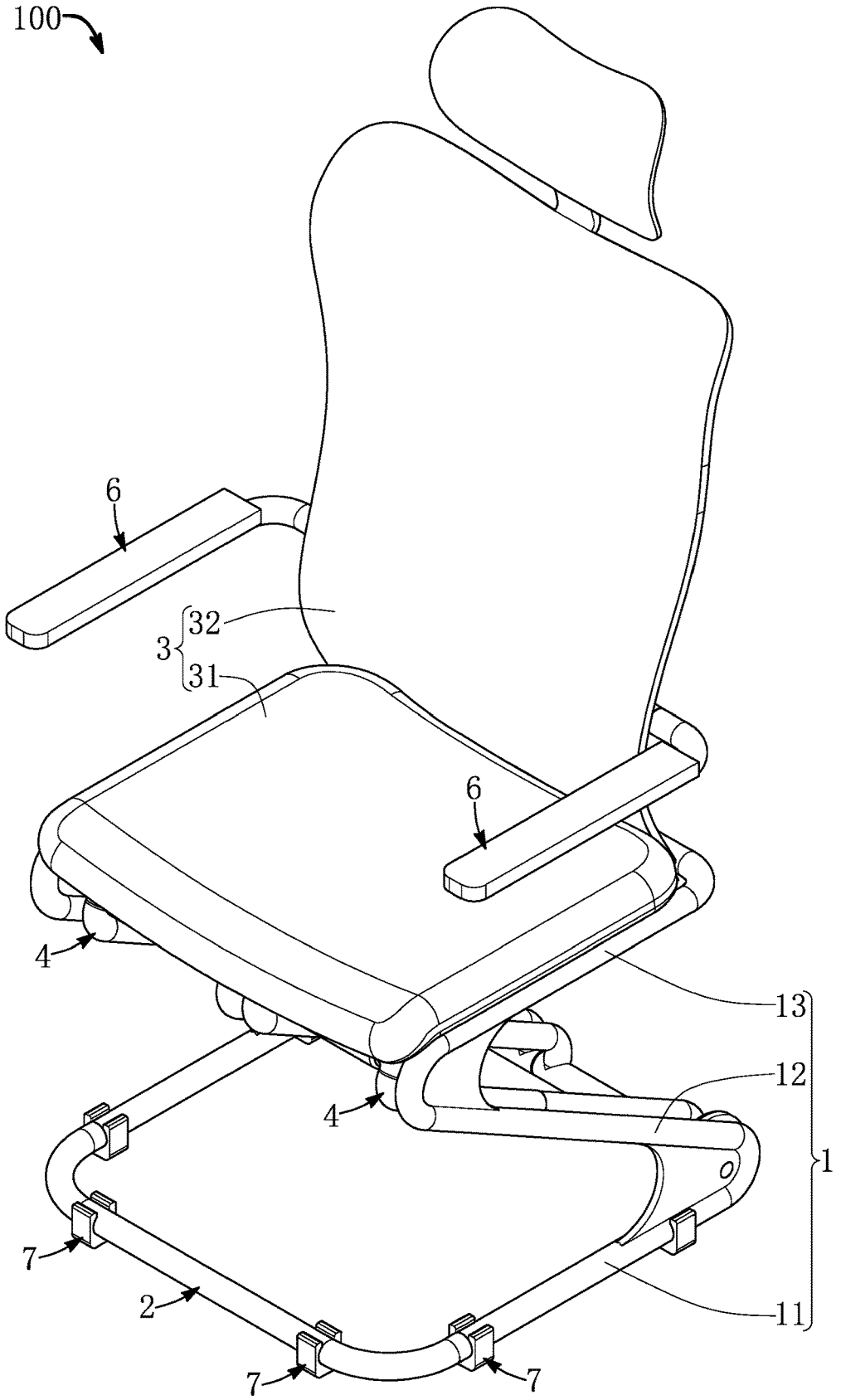
FIG. 1 to FIG. 3 are schematic views of a multifunctional chair provided by the present disclosure at different viewing angles, respectively.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a," "an" and "the" includes plural reference, and the meaning of "in" includes "in" and "on." Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first," "second" or "third" can be used to describe various components, signals or the like, which are for distinguishing one component/signal from another one only, and are not intended to, nor should be construed to impose any substantive limitations on the components, signals or the like.

Figure 2:
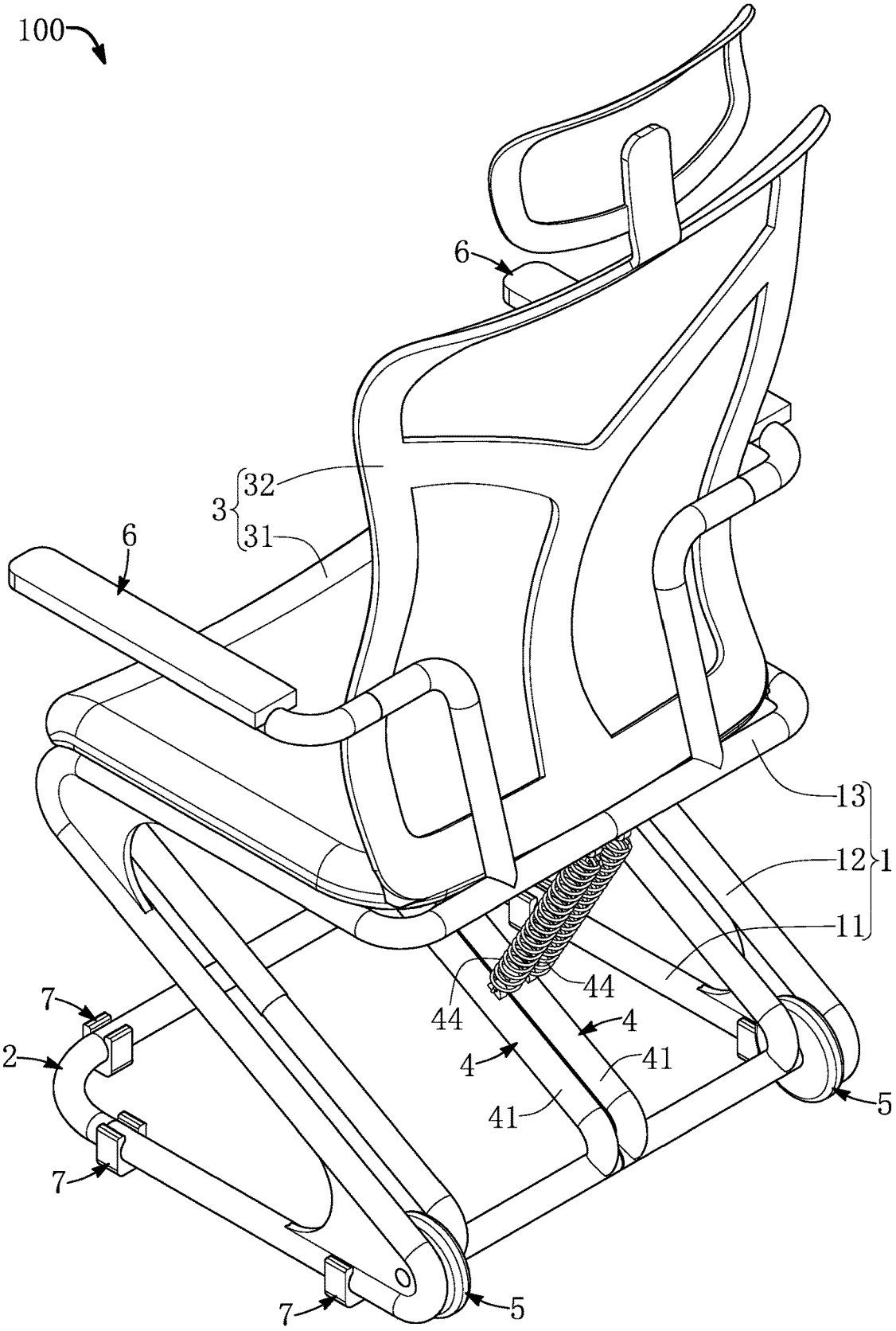
Figure 3:
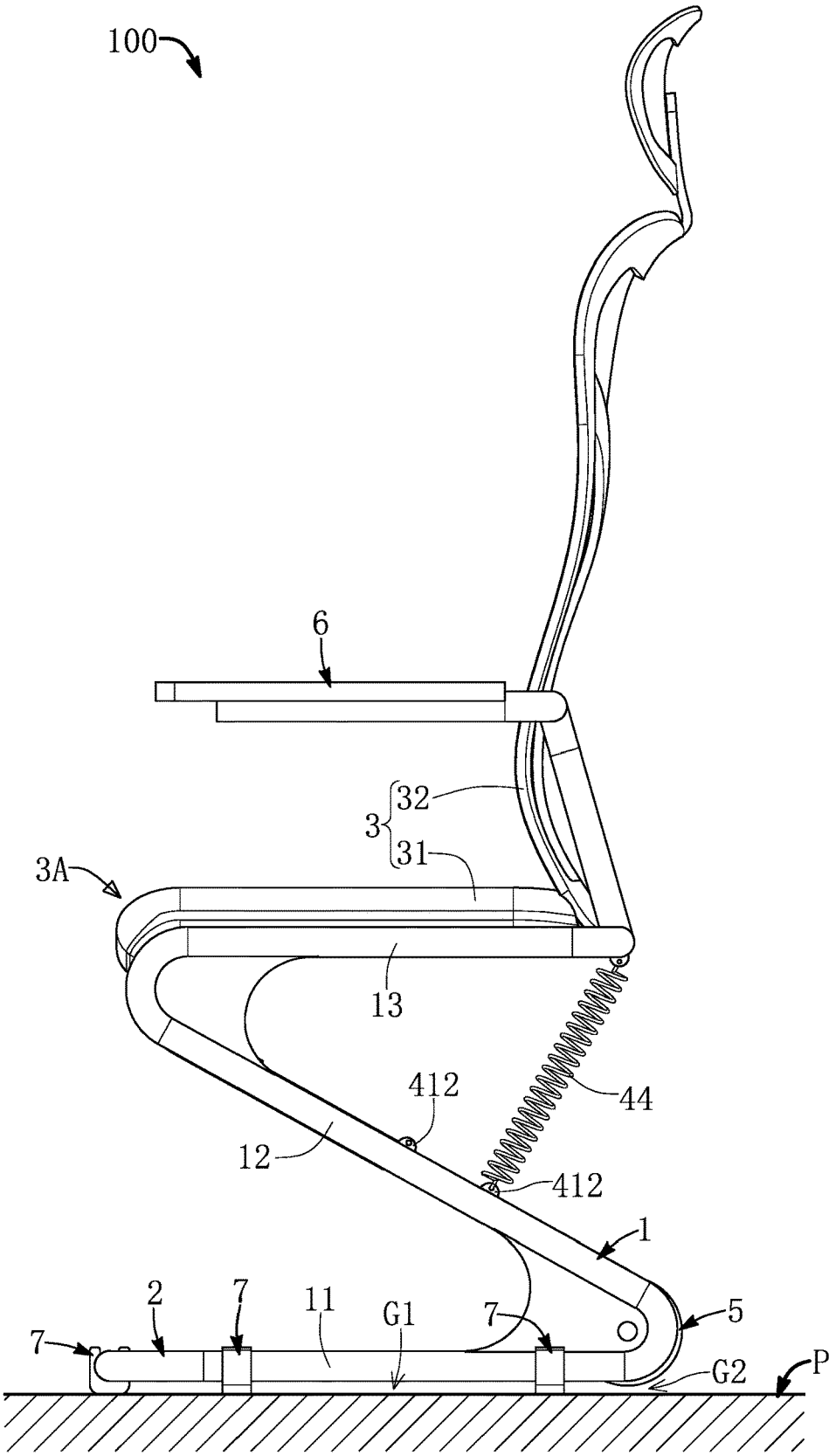
Figure 4:
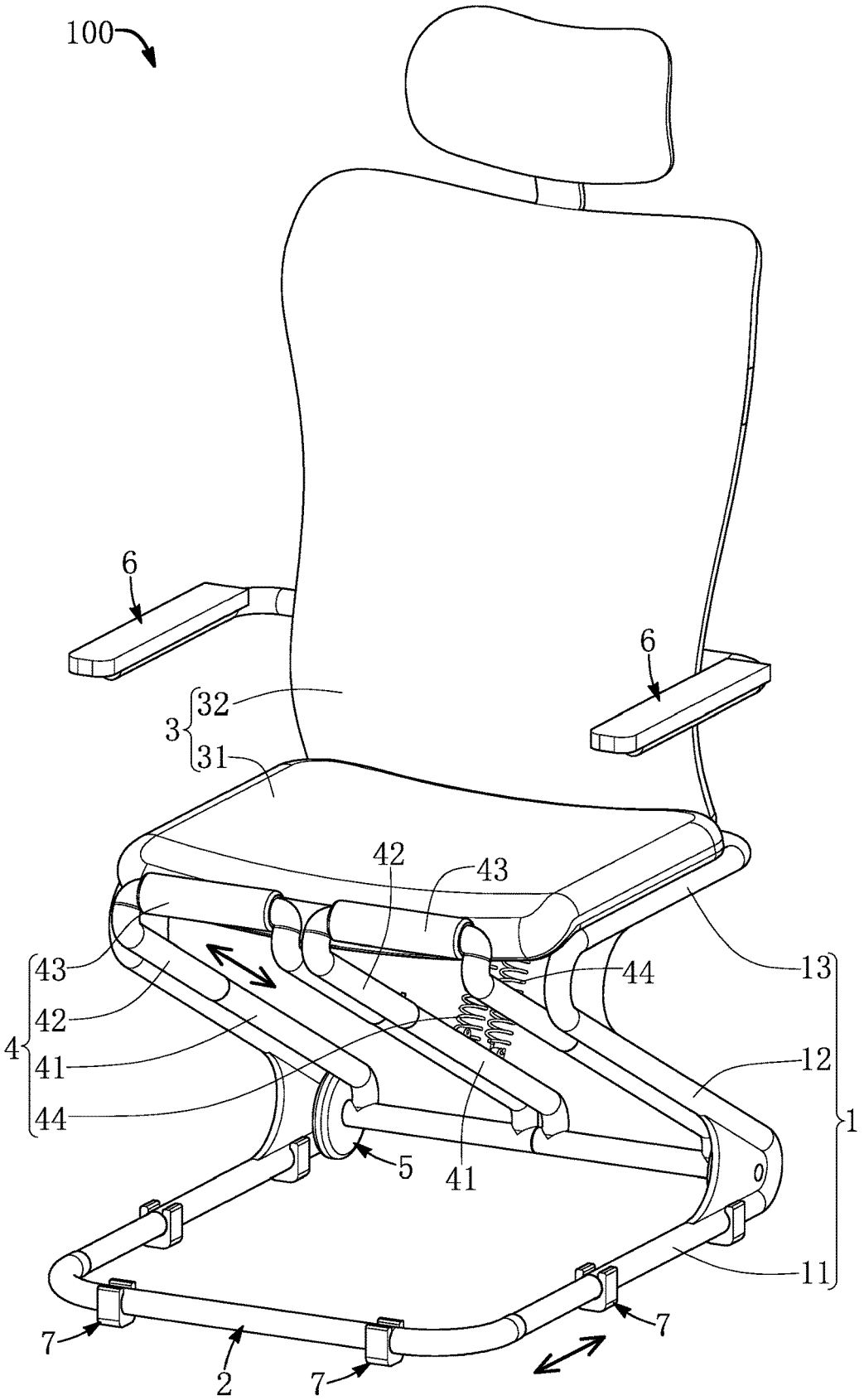
FIG. 4 and FIG. 5 are schematic views of a telescopic structure and a movable rod of the multifunctional chair provided by the present disclosure after being operated, respectively.

Referring to FIG. 1 to FIG. 4, FIG. 1 to FIG. 3 are schematic views of a multifunctional chair provided by the present disclosure at different viewing angles, respectively, and FIG. 4 is a schematic side view of the multifunctional chair provided by the present disclosure sliding through two auxiliary wheels. The present disclosure provides a multifunctional chair 100 including a support body 1, a telescopic structure 2, a seat body 3, two pedal assemblies 4, two auxiliary wheels 5 and two armrest structures 6. In different embodiments, the multifunctional chair 100 may also only include a single pedal assembly 4. In another embodiment, the multifunctional chair 100 may also not include the auxiliary wheels 5.

The support body 1 includes a placing part 11, two oblique rods 12 (or two inclined levers) and a fixed part 13. The placing part 11 is configured to be placed on the ground. The placing part 11 may be composed of a plurality of rods, for example, but the appearance of the placing part 11 and the components contained therein are not limited to what is shown in the figures. Two ends of each oblique rod 12 are respectively connected with the placing part 11 and the fixed part 13. The number of oblique rods 12 included in the support body 1, and the shape and the size of each oblique rod 12 are not limited to what is shown in the figures. The fixed part 13 is used to fix with the seat body 3. The fixed part 13 is mainly used to firmly connect the seat body 3 with the support body 1, so that the shape, the size, and the components included in the fixed part 13 can be determined or designed according to the shape, size, etc. of the seat body 3.

Figure 5:
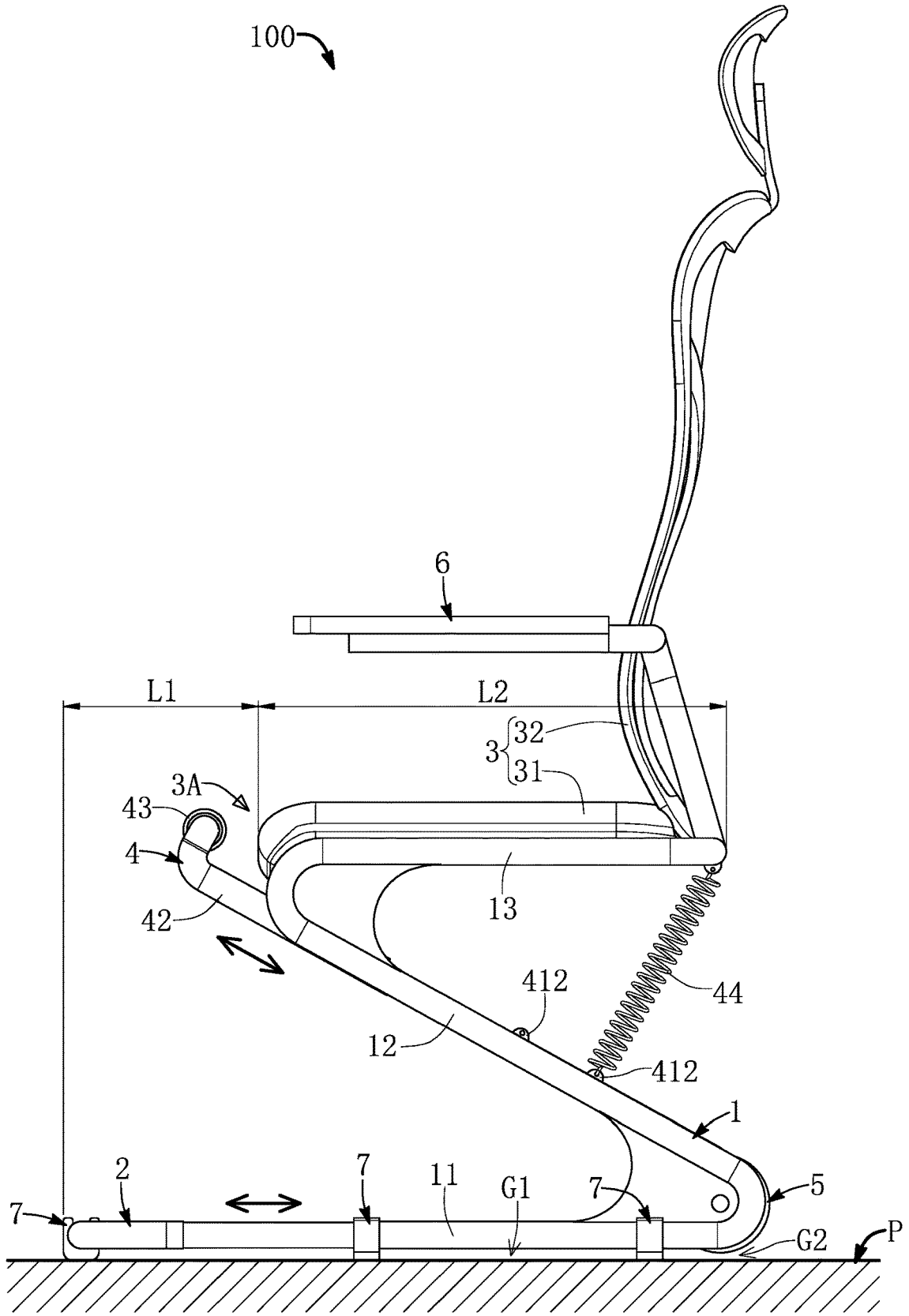

The telescopic structure 2 is movably connected with the placing part 11, and the telescopic structure 2 can be operated to move away from or close to the support body 1 relative to the placing part 11. Specifically, the telescopic structure 2 can be operated to move away from the support body 1, so that the telescopic structure 2 protrudes from the front edge 3A of the seat body 3 (as shown in FIG. 5 and FIG. 6), or the telescopic structure 2 can be operated to move toward a direction close to the support body 1, so that the telescopic structure 2 does not protrude from the front edge 3A of the seat body 3 (as shown in FIG. 1 and FIG. 3).

In practical applications, the placing part 11 may include two hollow tubes, the telescopic structure 2 may include two tubes, and the two tubes of the telescopic structure 2 may be correspondingly arranged in the two hollow tubes of the placing part 11. When the telescopic structure 2 is operated, the two tubes of the telescopic structure 2 can move relative to the two hollow tubes of the placing part 11. The specific connecting and fixing method between the telescopic structure 2 and the placing part 11 is not limited to what is shown in the figures. In one of the embodiments, the telescopic structure 2 can be fixed to the placing part 11 by, for example, a plurality of screws, or the telescopic structure 2 can be provided with two operating components. When each operating component is not operated, the telescopic structure 2 and the placing part 11 are fixed to each other, and when the two operating components are operated, the telescopic structure 2 will be able to telescopically move relative to the placing part 11.

The seat body 3 can include a seat plate structure 31 and a backrest structure 32. The rear edge of the seat plate structure 31 is connected with the backrest structure 32. The seat plate structure 31 is used to provide a seat for the user, and the backrest structure 32 is used to provide support for the user's back. The seat plate structure 31 is fixed to the fixed part 13 of the support body 1. The shapes and sizes of the seat plate structure 31 and the backrest structure 32 are not limited to what is shown in the figures.

Figure 6:
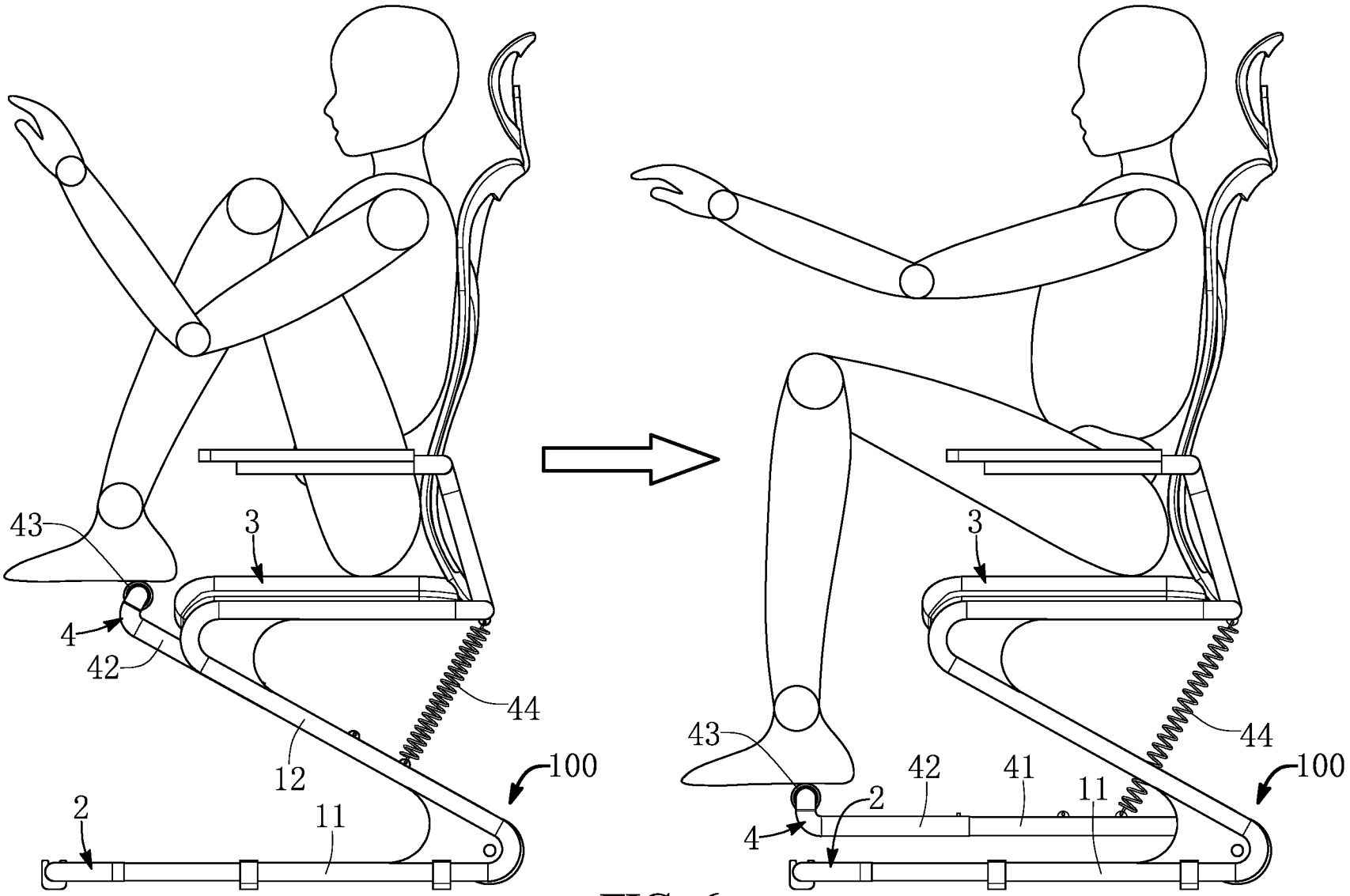
FIG. 6 is a schematic view of a user exercising using the multifunctional chair provided by the present disclosure.

Referring to FIG. 1 and FIG. 3 to FIG. 6, FIG. 4 and FIG. 5 are schematic views of the telescopic structure and the movable rod of the multifunctional chair provided by the present disclosure after being operated, respectively, and FIG. 6 is a schematic view of a user exercising using the multifunctional chair provided by the present disclosure. The two pedal assemblies 4 are connected with the support body 1. Each pedal assembly 4 includes a fixing rod 41, a movable rod 42, an operating element 43 and an elastic resistance element 44. One end of the fixing rod 41 is pivotally connected to the support body 1. The movable rod 42 is telescopically connected with the fixing rod 41. The operating element 43 is disposed on an end of the movable rod 42 opposite to the fixing rod 41. The operating element 43 and the movable rod 42 are connected with each other to form a substantially T-shaped structure, but not limited thereto. Each operating element 43 is mainly used for the user to press by the soles or palms. Two ends of the elastic resistance element 44 are respectively fixed to the support body 1 and the fixing rod 41. The elastic resistance element 44 is, for example, a tension spring, but it is not limited thereto. Any elastically deformable element that can provide elastic resistance falls within the scope of application of the elastic resistance element 44.

Each movable rod 42 can be operated to move relative to the fixing rod 41 to which it is connected, and each operating element 43 can be stored under the corresponding seat body 3, or each operating element 43 can protrude from the front edge 3A of the corresponding seat body 3. When the user operates the telescopic structure 2 and the two movable rods 42 to make the telescopic structure 2 and the two operating elements 43 protrude from the front edge 3A of the seat body 3, the user can use the multifunctional chair 100 to perform related muscle training exercises.

More specifically, as shown in FIG. 6, when the user sitting on the seat body 3 applies force on the two operating elements 43 through both feet, the two operating elements 43, the movable rod 42 and the fixing rod 41 can be rotated relative to the support body 1, and the two elastic resistance elements 44 will be driven to assume a stretched state, thereby providing elastic resistance. That is to say, when the user's feet step on the two operating elements 43, they must resist the elastic resistance provided by the two elastic resistance elements 44, thereby achieving the effect of training the user's muscles.

According to the above, when the user wants to use the multifunctional chair 100 to perform related muscle training exercises, the user only needs to make the two operating elements 43 and the telescopic structure 2 protrude from the front edge 3A of the seat plate structure 31 through simple operations, and then the user can start exercising. After the user finishes exercising, the two operating elements 43 and the telescopic structure 2 can be stored inward through a simple operation, so that the two operating elements 43 and the telescopic structure 2 no longer protrude from the front edge 3A of the seat plate structure 31, in this way, the multifunctional chair 100 can be used as a general office chair.

It should be noted that, through the design of the telescopic structure 2, the support body 1 can have a larger area in contact with the ground P, so that when the user uses the multifunctional chair 100 to exercise, the multifunctional chair 100 will not fall over. That is to say, if the multifunctional chair 100 is not designed with the telescopic structure 2, unless the weight of the multifunctional chair 100 itself is heavy, the multifunctional chair 100 may fall over when the user uses the multifunctional chair 100 for exercise.

In a preferred embodiment, after the telescopic structure 2 is operated, a length L1 protruding from the front edge 3A of the seat body 3 is not less than one-third of the length L2 of the seat plate structure 31, so that it will be able to effectively avoid the problem that the multifunctional chair 100 will fall over when the user is using the multifunctional chair 100, especially in an embodiment where the overall weight of the multifunctional chair 100 is relatively light.

Figure 7:
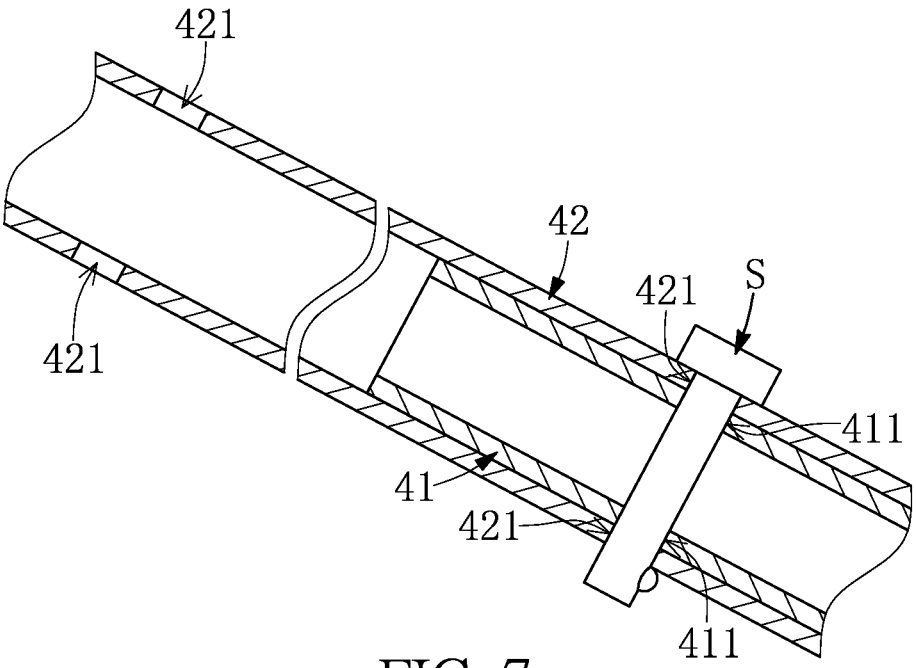
FIG. 7 is a partial schematic cross-sectional view of the movable rod and a fixing rod of the multifunctional chair provided by the present disclosure.

As shown in FIG. 7, it is a partial schematic cross-sectional view of the movable rod and the fixing rod of the multifunctional chair provided by the present disclosure. In one of the specific embodiments, the movable rod 42 may include two position-limiting holes 421, the fixing rod 41 may include a position-limiting hole 411, and the user may use a pin S (or bolt, latch or plug) to pass through one of position-limiting holes 421 of the movable rod 42 and the position-limiting hole 411 of the fixing rod 41 so as to prevent the movable rod 42 from moving relative to the fixing rod 41. It should be noted that, the manner of fixing the movable rod 42 and the fixing rod 41 is not limited to the above description, and it can be changed according to different requirements. Certainly, in different embodiments, the pin S may also be replaced by any different component such as a screw.

As shown in FIG. 3, FIG. 5 and FIG. 7, when the pin S passes through one of the position-limiting holes 421 of the movable rod 42 and the position-limiting hole 411 of the fixing rod 41, the operating element 43 protrudes from the front edge 3A of the seat plate structure 31 (as shown in FIG. 5). On the contrary, when the pin S passes through another position-limiting hole 421 of the movable rod 42 and the position-limiting hole 411 of the fixing rod 41, the operating element 43 does not protrude from the front edge 3A of the seat plate structure 31 (as shown in FIG. 3). That is to say, the position-limiting holes 421 of the movable rod 42, the position-limiting hole 411 of the fixing rod 41 and the pin S are mainly used to cooperate with each other so that the operating element 43 protrudes or does not protrude from the front edge 3A of the seat plate structure 31. Of course, making the operating element 43 protrude or not protrude from the front edge 3A of the seat plate structure 31 is not limited to that described above.

Figure 8:
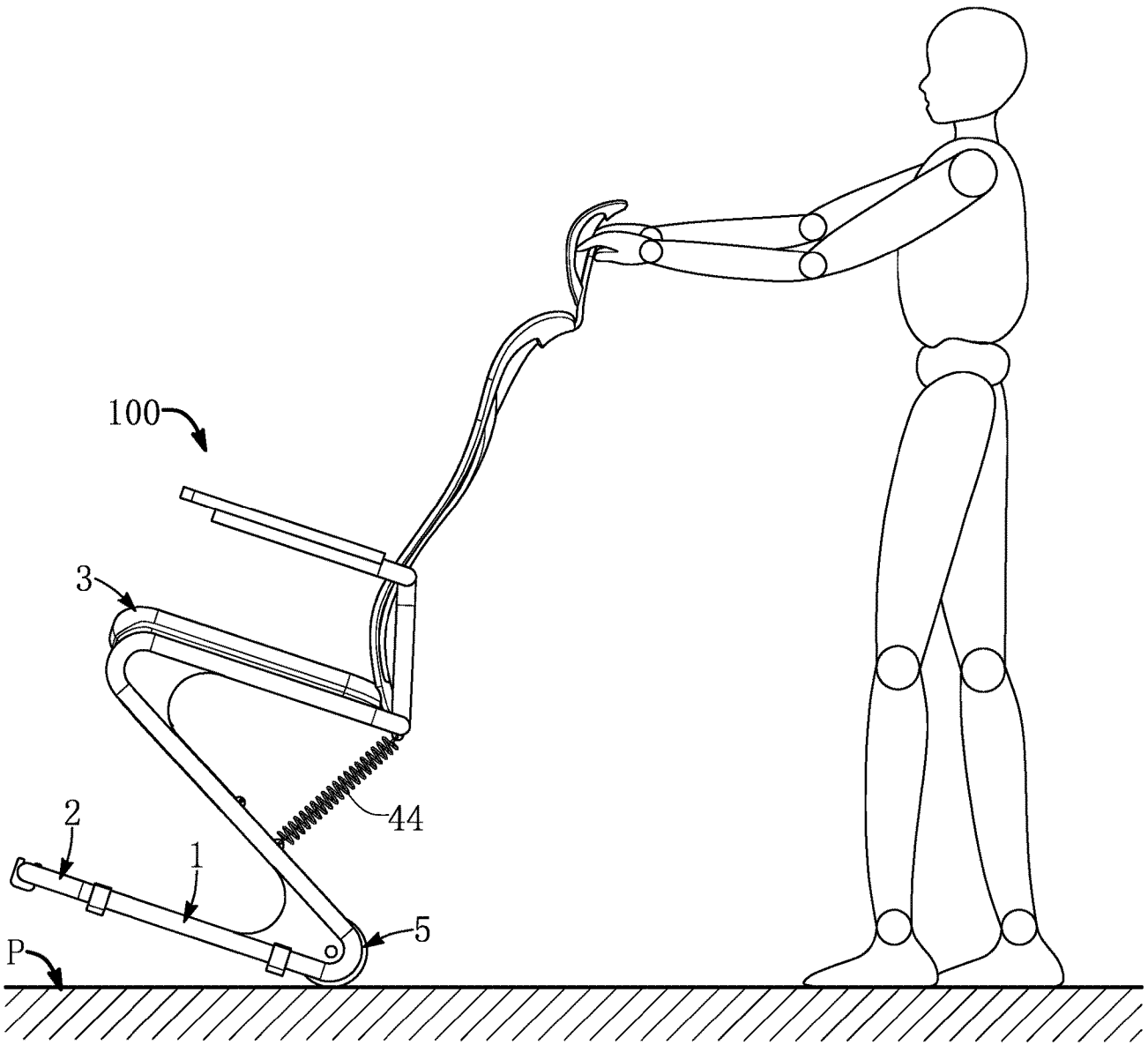
FIG. 8 is a schematic side view of the multifunctional chair provided by the present disclosure sliding through auxiliary wheels.

Referring to FIG. 2, FIG. 3 and FIG. 8. FIG. 8 is a schematic side view of the multifunctional chair provided by the present disclosure sliding through the auxiliary wheels. The rear end of the placing part 11 of the support body 1 may be pivotally connected with two auxiliary wheels 5, and each auxiliary wheel 5 can rotate relative to the support body 1. As shown in FIG. 3, when the placing part 11 is placed on the ground P, each auxiliary wheel 5 does not contact the ground P. As shown in FIG. 8, when the user tilts the multifunctional chair 100 to make the two auxiliary wheels 5 contact the ground P, the user can easily slide the multifunctional chair 100 through the two auxiliary wheels 5.

That is to say, in general, when the user sits on the multifunctional chair 100, each auxiliary wheel 5 will not contact the ground P, so that the multifunctional chair 100 can be placed firmly on the ground P, and when the user uses the multifunctional chair 100 to exercise, since each auxiliary wheel 5 does not contact the ground P, the multifunctional chair 100 will not have the problem of moving.

Based on the above, referring to FIG. 2 and FIG. 3 again, in one specific embodiment, the multifunctional chair 100 may further include a plurality of auxiliary fixing components 7. The plurality of auxiliary fixing components 7 are fixed to the placing part 11, and the placing part 11 is placed on the ground P through the plurality of auxiliary fixing components 7. When the support body 1 is placed on the ground P through the plurality of auxiliary fixing components 7, a gap G1 is formed between the support body 1 and the ground P, and a gap G2 is formed between each auxiliary wheel 5 and the ground P. Each auxiliary fixing component 7 is, for example, made of rubber material, and each auxiliary fixing component 7 can make the support body 1 be placed on the ground P more stably.

Figure 9:
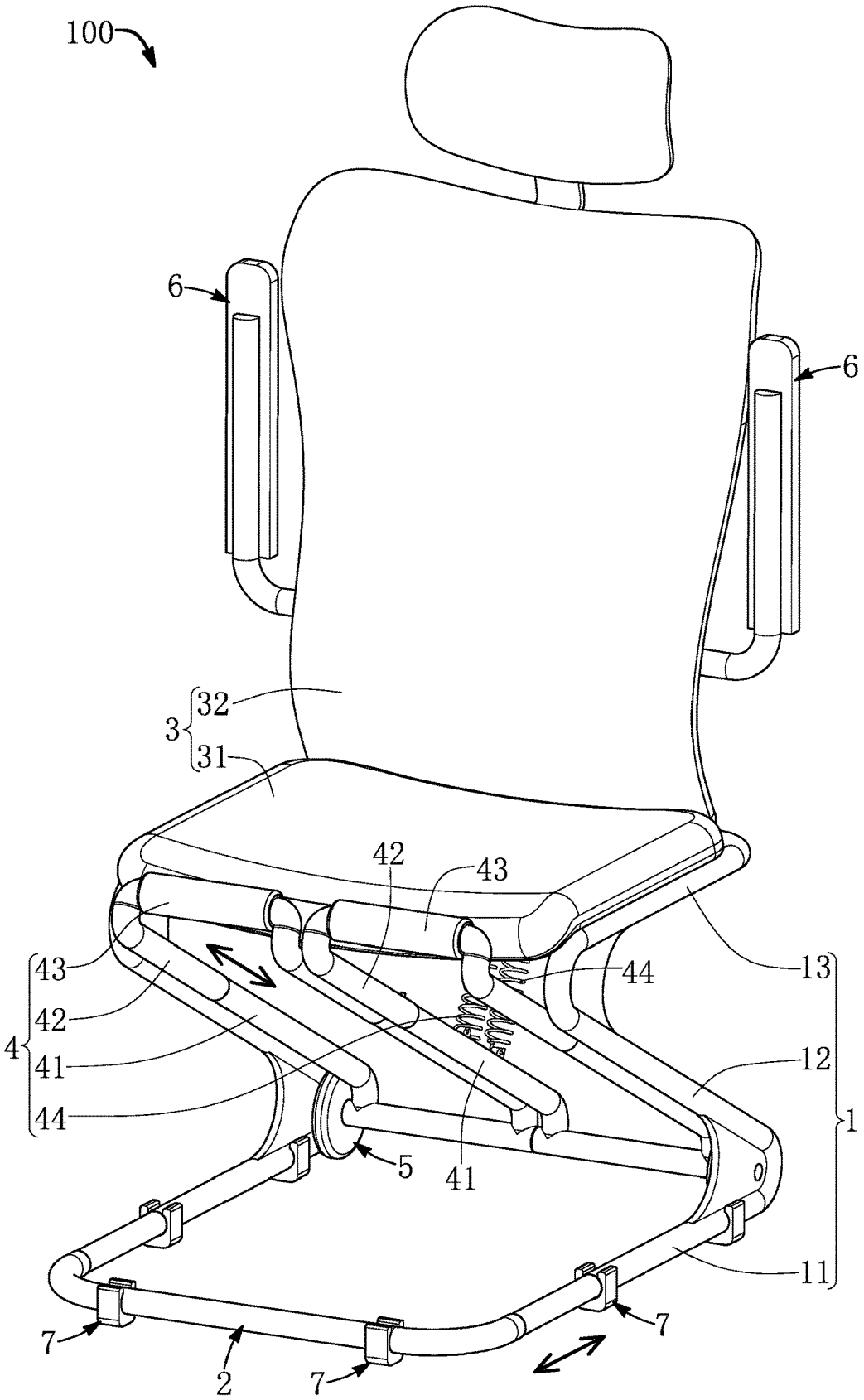
FIG. 9 is a schematic view of two armrest structures of the multifunctional chair provided by the present disclosure after being operated.
Figure 10:
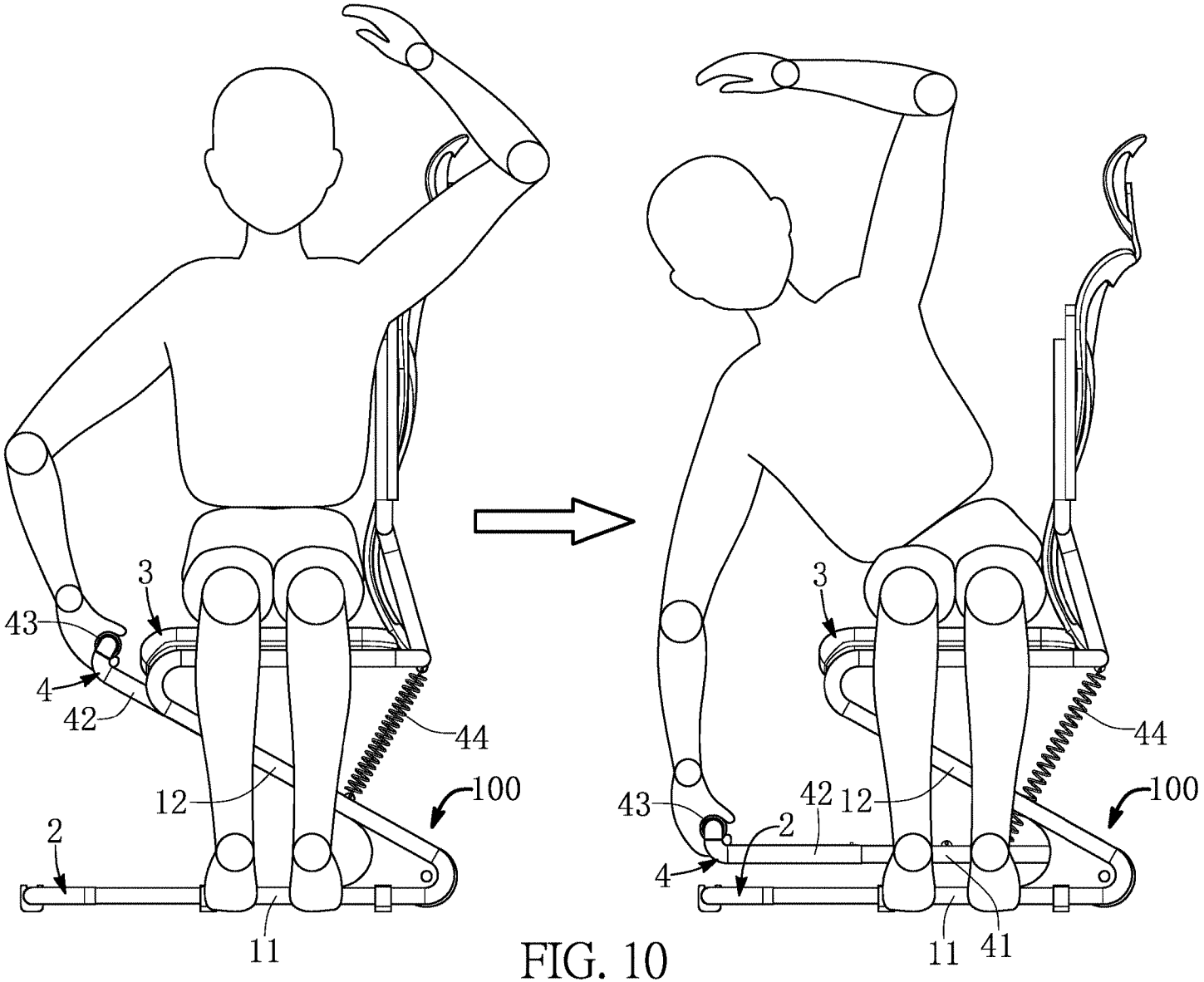
FIG. 10 is another schematic view of the user exercising using the multifunctional chair provided by the present disclosure.

Referring to FIG. 2, FIG. 9 and FIG. 10 together, FIG. 9 is a schematic view of the two armrest structures of the multifunctional chair provided by the present disclosure after being operated, and FIG. 10 is another schematic view of a user exercising using the multifunctional chair provided by the present disclosure. As shown in FIG. 2 and FIG. 9, the two armrest structures 6 are respectively movably connected to the support body 1, and each armrest structure 6 can be operated and rotated to approach or move away from the backrest structure 32 relative to the support body 1. In practical applications, each armrest structure 6 can be operated to rotate 90 degrees clockwise or counterclockwise.

As shown in FIG. 9 and FIG. 10, when the user rotates the two armrest structures 6 relative to the support body 1 by 90 degrees, and makes the operating element 43 protrude from the front edge 3A of the seat plate structure 31, the user can sit sideways on the seat plate structure 31, and the user can use the left hand to press the operating element 43 to exercise and stretch the body. In contrast, if the user intends to use the right hand to press the operating element 43, the user only needs to sit on the seat body 3 reversely, and the user can use the left hand to press the operating element 43.

Figure 11:
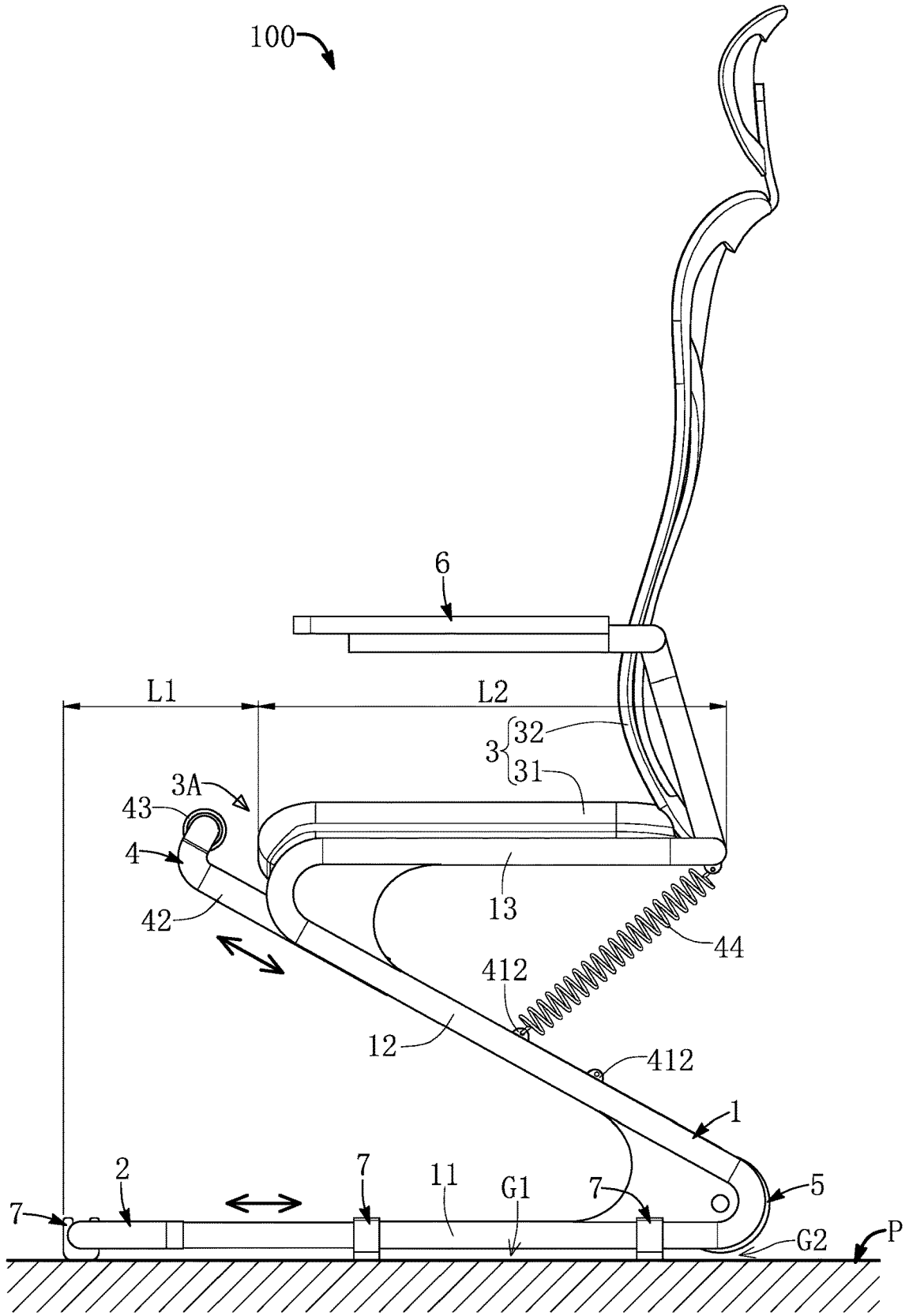
FIG. 11 is a schematic side view of the multifunctional chair provided by another embodiment of the present disclosure.

Referring to FIG. 11, FIG. 11 is a schematic side view of the multifunctional chair provided by another embodiment of the present disclosure. In practical applications, the fixing rod 41 may include two fixing structures 412, and one end of the elastic resistance element 44 is detachably fixed to one of the fixing structures 412. When the user fixes one end of the elastic resistance element 44 to different fixing structures 412, the user will have to apply different forces to rotate the operating element 43 toward the ground, thereby achieving different elastic resistance training requirements.

Figure 12:
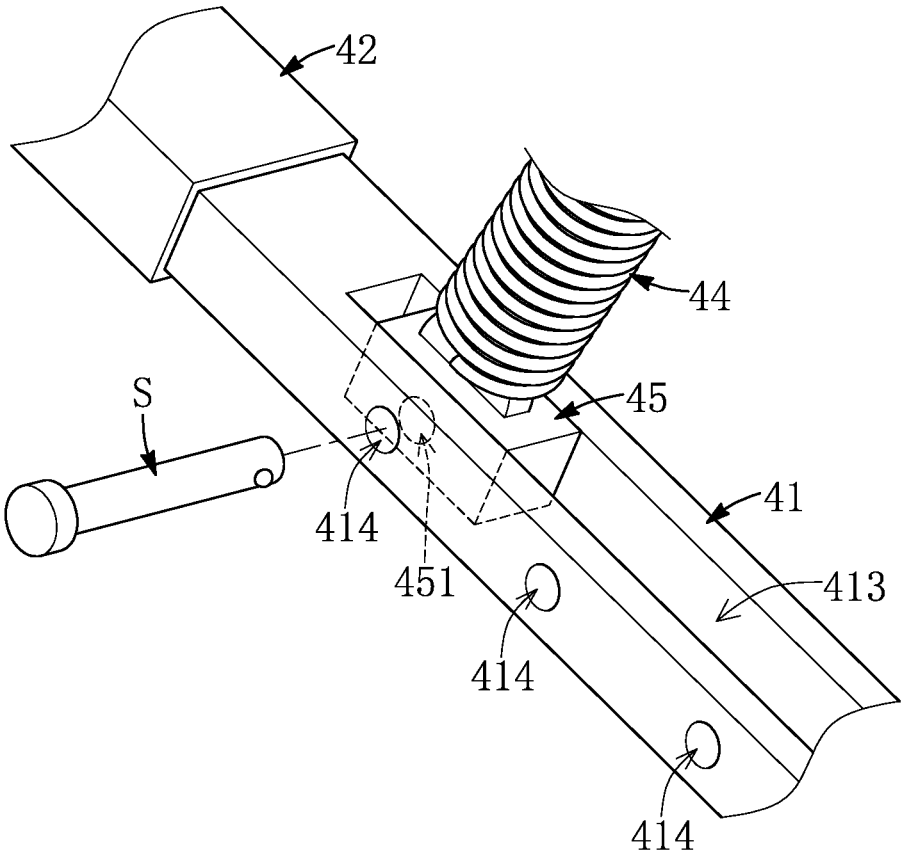
FIG. 12 is a partial schematic enlarged view of the fixing rod and an elastic resistance element of the multifunctional chair connected with each other according to one embodiment of the present disclosure.

Referring to FIG. 12, FIG. 12 is a partial schematic view of the pedal assembly of the multifunctional chair provided by one embodiment of the present disclosure. In one of the specific embodiments, the fixing rod 41 of the pedal assembly 4 can be concavely formed with a sliding groove 413, the side wall of the fixing rod 41 forming the sliding groove 413 has a plurality of position-limiting holes 414, and a sliding block 416 is arranged in the sliding groove 413. One end of the elastic resistance element 44 is fixed to the sliding block 45, and the sliding block 45 can slide in the sliding groove 413. The sliding block 45 has a through hole 451 passing through the sliding block 45.

The user can use a pin S to pass through one of the position-limiting holes 414 and the through hole 451 of the sliding block 45, so that the sliding block 45 cannot move relative to the fixing rod 41, so as to change the fixed position of the elastic resistance element 44 and the fixing rod 41. That is to say, through the design of the sliding block 45, the sliding groove 413, the pin S, etc., the user can change the position where the elastic resistance element 44 and the fixing rod 41 are fixed to each other through simple operations according to the demand for elastic resistance. Of course, in different embodiments, the pin S may also be replaced by a different component such as a screw.

Figure 13:
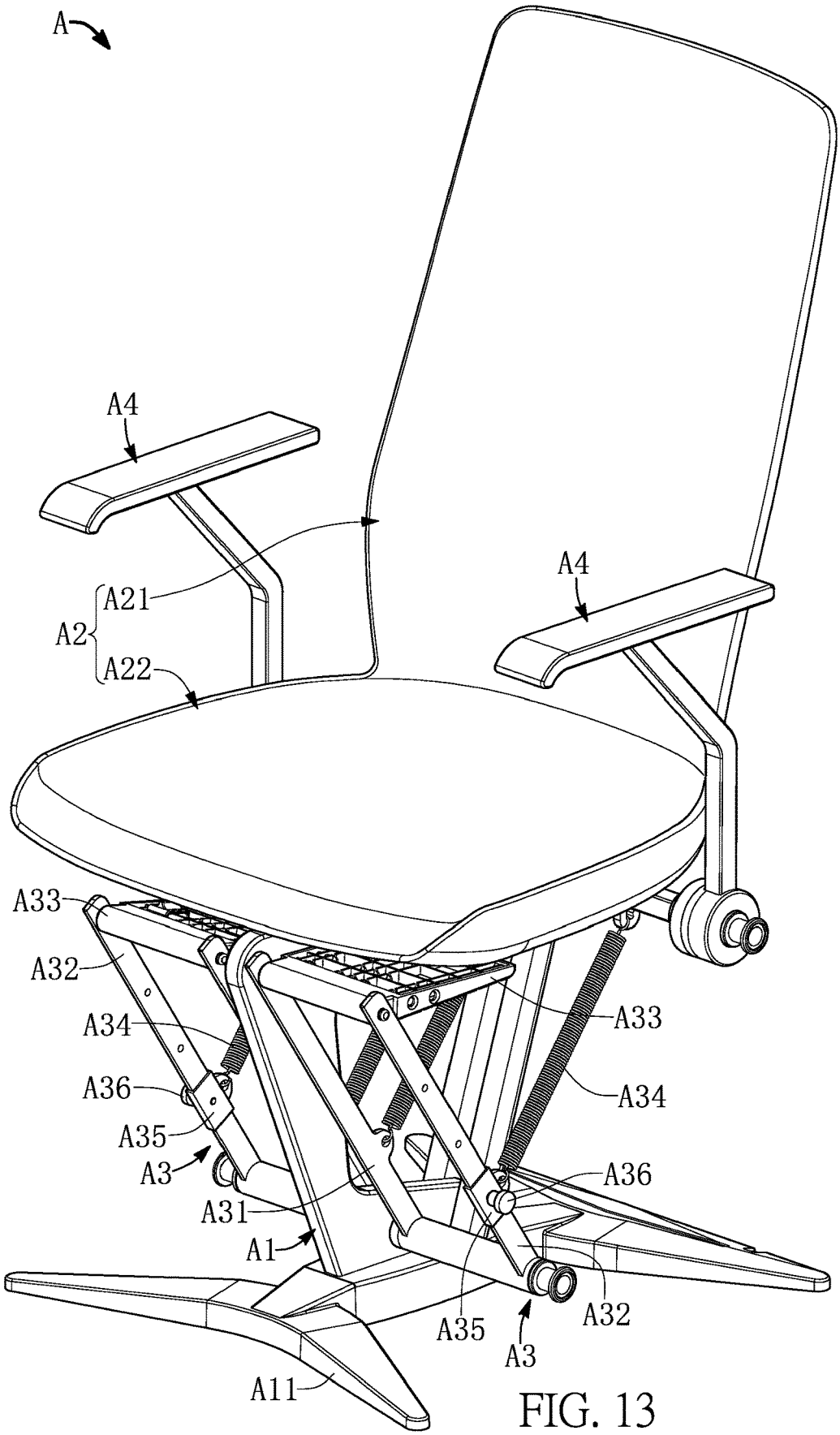
FIG. 13 to FIG. 15 are schematic views of the multifunctional chair provided by the present disclosure at different viewing angles, respectively.
Figure 14:
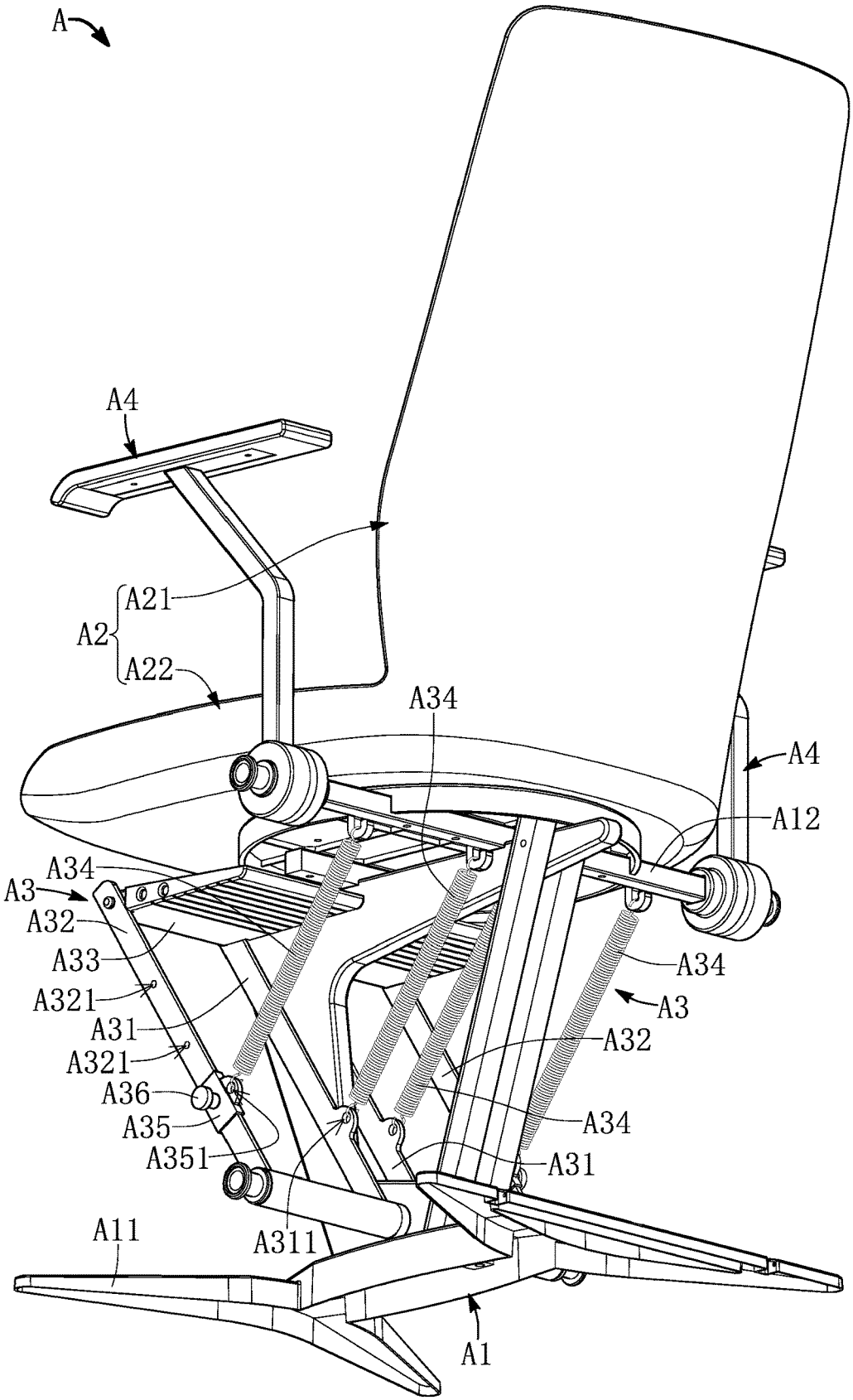
Figure 15:
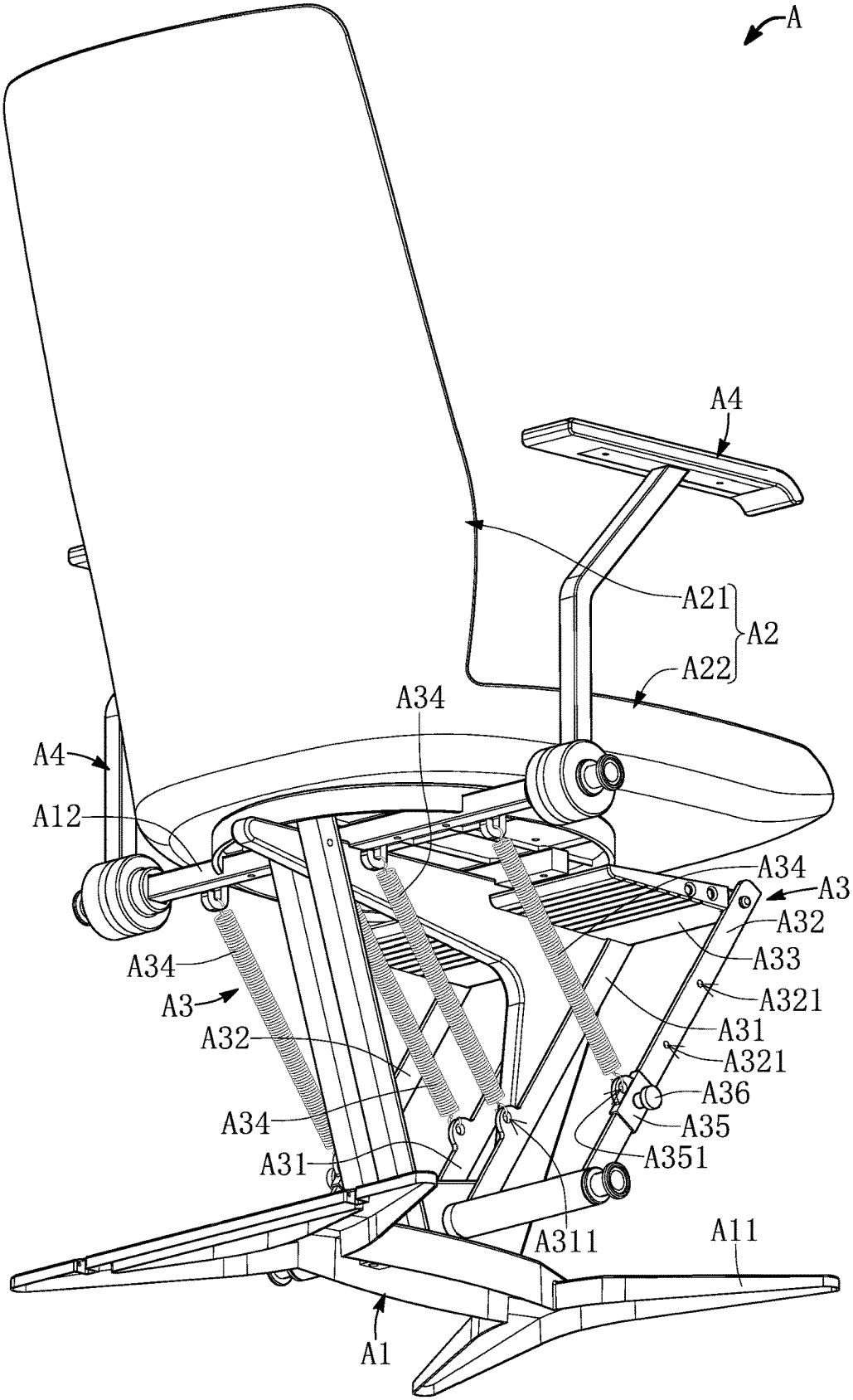
Figure 16:
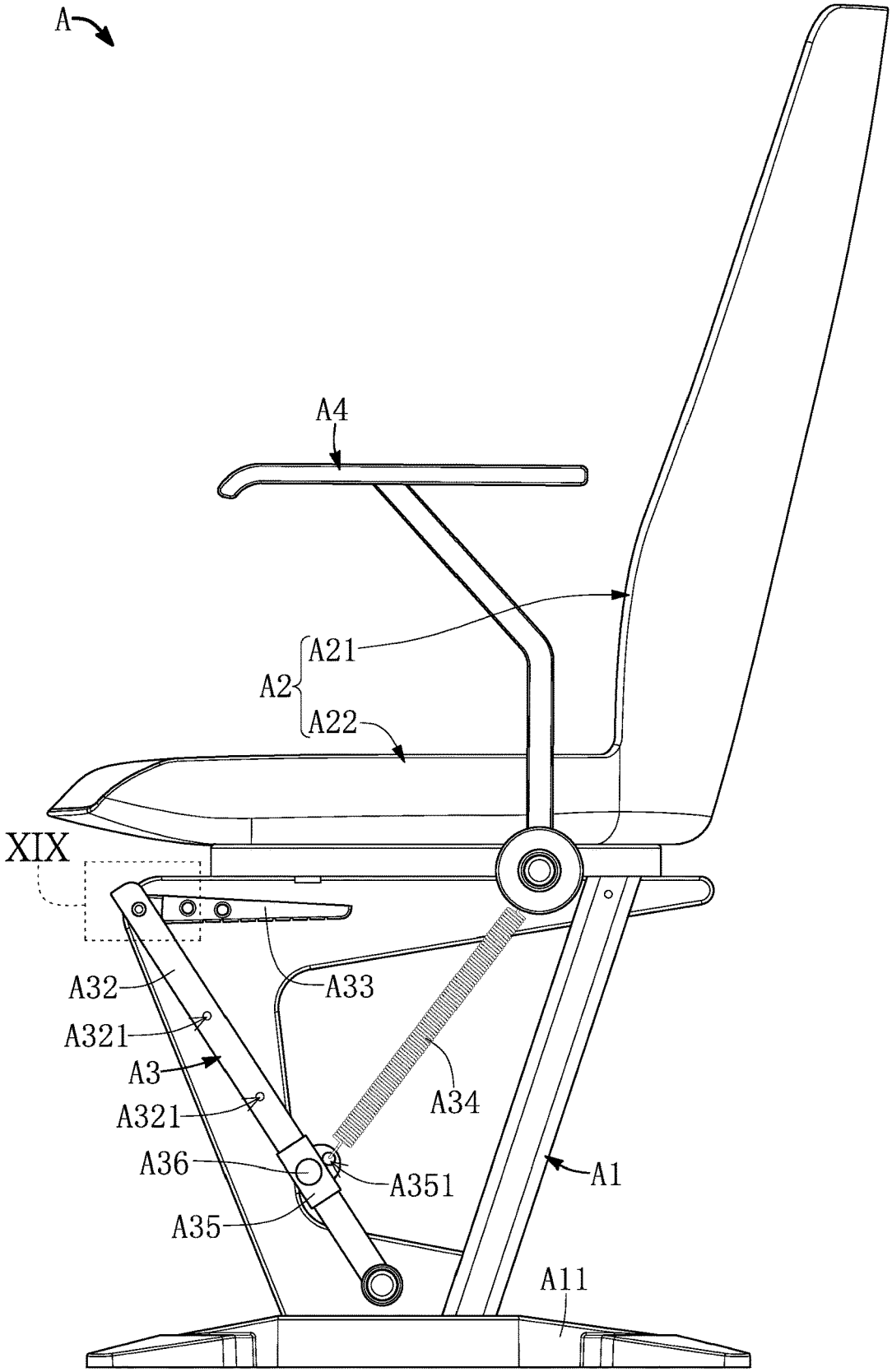
FIG. 16 is a schematic side view of the multifunctional chair provided by the present disclosure.

Referring to FIG. 13 to FIG. 16 together, FIG. 13 to FIG. 15 are schematic views of the multifunctional chair provided by the present disclosure at different viewing angles, respectively, and FIG. 16 is a schematic side view of the multifunctional chair provided by the present disclosure. The multifunctional chair A of the present disclosure includes a support body A1, a seat body A2 and two pedal assemblies A3. The support body A1 includes a placing part A11 and a fixed part A12. The placing part A11 is used for placing the multifunctional chair A on the ground. The fixed part A12 is connected with the placing part A11. The seat body A2 is connected with the fixed part A12. The fixed part A12 is mainly used to connect the placing part A11 and the seat body A2, and the fixed part A12 is also used to fix one end of the elastic resistance element A34. The components contained in the fixed part A12 and their appearance are not limited to what is shown in the figures. As long as the same function can be achieved, the components contained in the fixed part A12 and their appearance can be changed according to different requirements.

The seat body A2 includes a backrest structure A21 and a seat plate structure A22. The seat plate structure A22 is connected with the fixed part A12. The backrest structure A21 is connected with the rear edge of the seat plate structure A22. The functions of the support body A1 and the seat body A2 in this embodiment are substantially the same as those of the support body 1 and the seat body 3 in the foregoing embodiments, and will not be repeated here. The shape and the size of the placing part A11 and the seat body A2 are not limited to what is shown in the figures.

Each pedal assembly A3 includes two fixing rods, an operating element A33 and two elastic resistance elements A34, and the two fixing rods are respectively defined as an inner fixing rod A31 and an outer fixing rod A32. In the figures of this embodiment, each pedal assembly A3 includes two fixing rods (including the inner fixing rod A31 and the outer fixing rod A32) and two elastic resistance elements A34 as an example, but the number of the fixing rods included in each pedal assembly A3 and the elastic resistance elements A34 is not limited to two.

The two inner fixing rods A31 included in the two pedal assemblies A3 are arranged adjacent to each other, and the two inner fixing rods A31 are located below the seat body A2 and close to the center, and the two outer fixing rods A32 are located below the seat body A2 and away from the center. That is to say, each outer fixing rod A32 is located on the outer side of the multifunctional chair A, so that the user can easily touch the outer fixing rod A32. Each inner fixing rod A31 is located on the inner side of the multifunctional chair A.

One end of the inner fixing rod A31 and one end of the outer fixing rod A32 are pivotally connected to the support body A1, and the other end of the inner fixing rod A31 and the other end of the outer fixing rod A32 are pivotally connected to the operating element A33. Each operating element A33 can be operated to rotate relative to the two fixing rods (including the inner fixing rod A31 and the outer fixing rod A32), and can be operated to switch between a storage position (as shown in FIG. 16) and a support position (as shown in FIG. 17).

One end of one of the elastic resistance elements A34 of each pedal assembly A3 is connected to a fixing structure A311 of the inner fixing rod A31, and one end of the other elastic resistance element A34 is connected to a fixing structure A351 of the outer fixing rod A32.

In practical applications, each elastic resistance element A34 can be a compression spring, and each fixing structure (A311, A351) can be a through hole (or a structure such as a hook, etc.), and one end of each elastic resistance element A34 is detachably connected with one of the fixing structures (A311, A351). The appearance, quantity and setting positions of the fixing structures (A311, A351) can be changed according to different requirements, and are not limited to what is shown in the figures.

Figure 17:
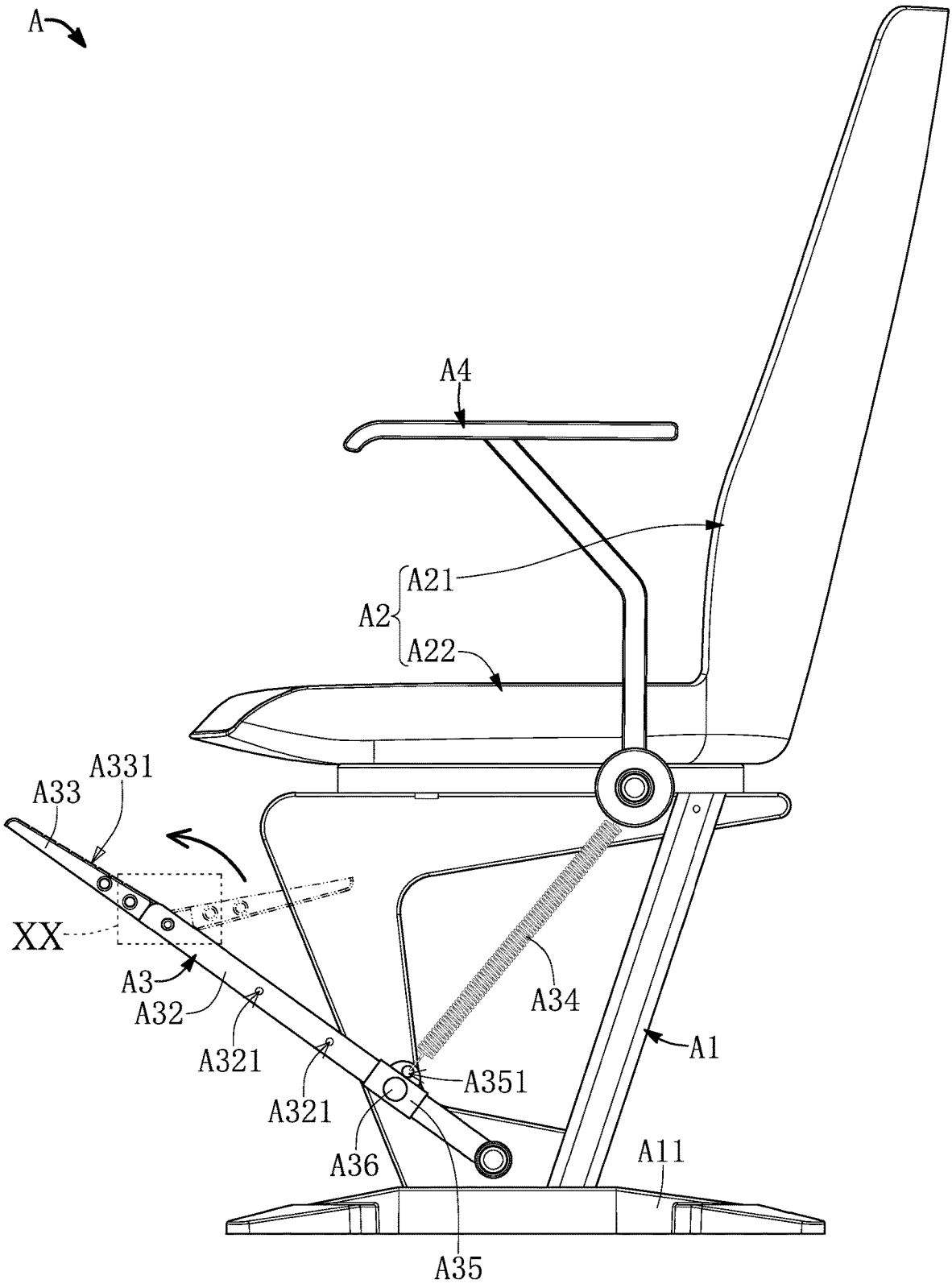
FIG. 17 is a schematic side view of the action of the multifunctional chair provided by the present disclosure.
Figure 18:
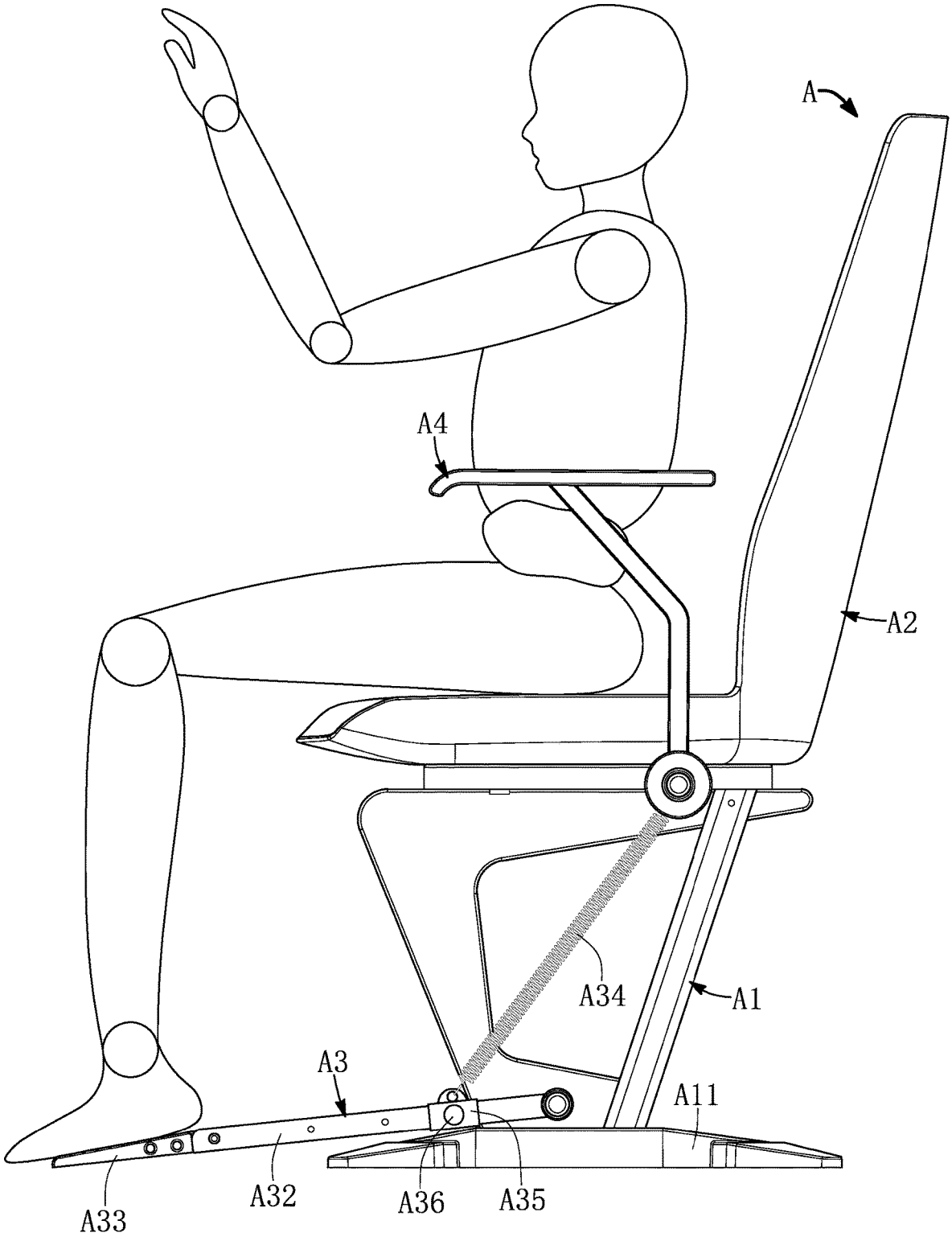
FIG. 18 is a schematic side view of the user exercising using the multifunctional chair provided by the present disclosure.

Referring to FIG. 16 to FIG. 18 together, FIG. 17 is a schematic side view of the action of the multifunctional chair provided by the present disclosure, and FIG. 18 is a schematic side view of the user exercising using the multifunctional chair provided by the present disclosure. As shown in FIG. 16, when the operating element A33 is at the storage position, the operating element A33 does not protrude from the front edge of the seat body A2, and the multifunctional chair A can be used as a general office chair at this time. As shown in FIG. 16 and FIG. 17, when the operating element A33 is located at the storage position (as shown in FIG. 16), if the user wants to use the multifunctional chair A for exercise, firstly the user can press the operating element A33 to rotate the inner fixing rod A31 and the outer fixing rod A32 connected to the operating element A33 in a direction away from the seat body A2, and then the user can turn the operating element A33 outward to switch the operating element A33 to the support position (as shown in FIG. 17).

As shown in FIG. 17 and FIG. 18, when the operating element A33 is at the support position, a contact surface A331 (or a stepping surface) of the operating element A33 will be exposed, and the operating element A33 will protrude from the front edge of the seat body A2. At this time, the user can step on the contact surface A331 of the operating element A33. When the user pedals the operating element A33 to make the operating element A33 drive the two fixing rods (including the outer fixing rod A32 and the inner fixing rod A31) to rotate, the two elastic resistance members A34 connected with the outer fixing rod A32 and the inner fixing rod A31 will be pulled to generate elastic recovery force, and the user will feel the resistance, so as to achieve the effect of exercise.

Figure 19:
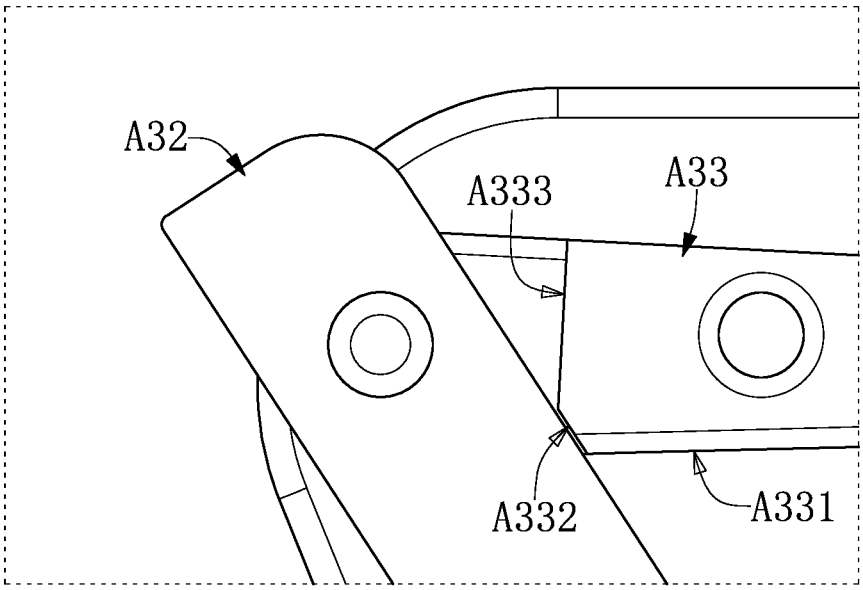
FIG. 19 is a partial schematic enlarged view of FIG. 16.
Figure 20:
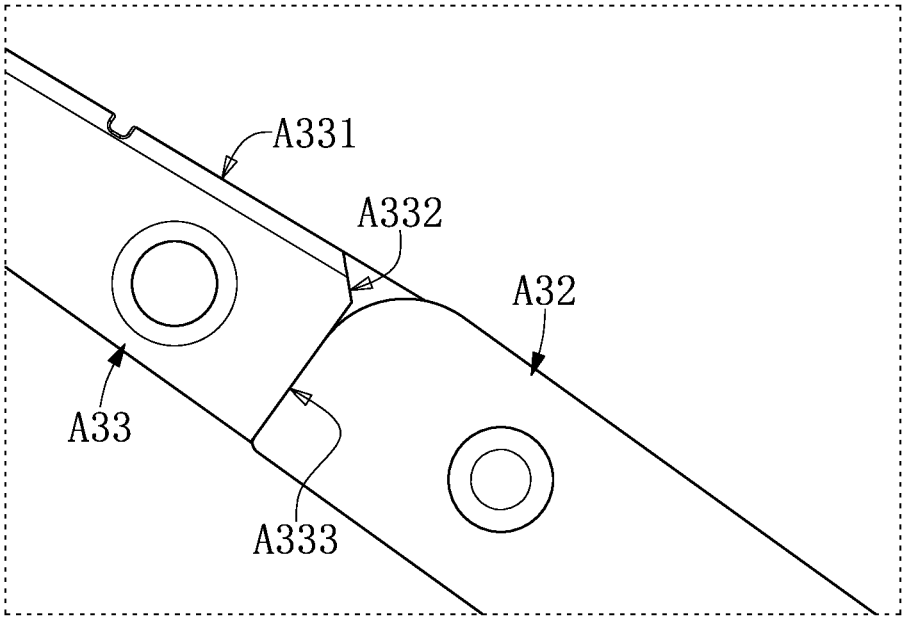
FIG. 20 is a partial schematic enlarged view of FIG. 17.

As shown in FIG. 16, FIG. 17, FIG. 19 and FIG. 20, in practical applications, the two sides of each operating element A33 may respectively include a first position-limiting portion A332 and a second position-limiting portion A333, and the first position-limiting portion A332 and the second position-limiting portion A333 are adjacent to the positions where the operating element A33 and the fixing rods (including the outer fixing rod A32 and the inner fixing rod A31) are pivotally connected to each other. As shown in FIG. 16 and FIG. 19, when the operating element A33 is at the storage position, the first position-limiting portion A332 will abut against the fixing rod (taking the outer fixing rod A32 as an example in the figure) to limit a movable range of the operating element A33 relative to the fixing rod (taking the outer fixing rod A32 as an example in the figure). As shown in FIG. 17 and FIG. 20, when the operating element A33 is at the support position, the second position-limiting portion A333 will abut against the fixing rod to limit a movable range of the operating element A33 relative to the fixing rod (taking the outer fixing rod A32 as an example in the figure).

That is to say, when the operating element A33 is operated and rotated to the storage position, the user will clearly feel that the two first position-limiting portions A332 of the operating element A33 have abutted against the outer fixing rod A32 and the inner fixing rod A31, and the operating element A33 can no longer rotate in a direction approaching the outer fixing rod A32 and the inner fixing rod A31. In contrast, when the operating element A33 is operated and rotated to the support position, the user will clearly feel that the two second position-limiting portions A333 of the operating element A33 have abutted against the outer fixing rod A32 and the inner fixing rod A31, but the operating element A33 cannot rotate in a direction away from the outer fixing rod A32 and the inner fixing rod A31.

Figure 21:
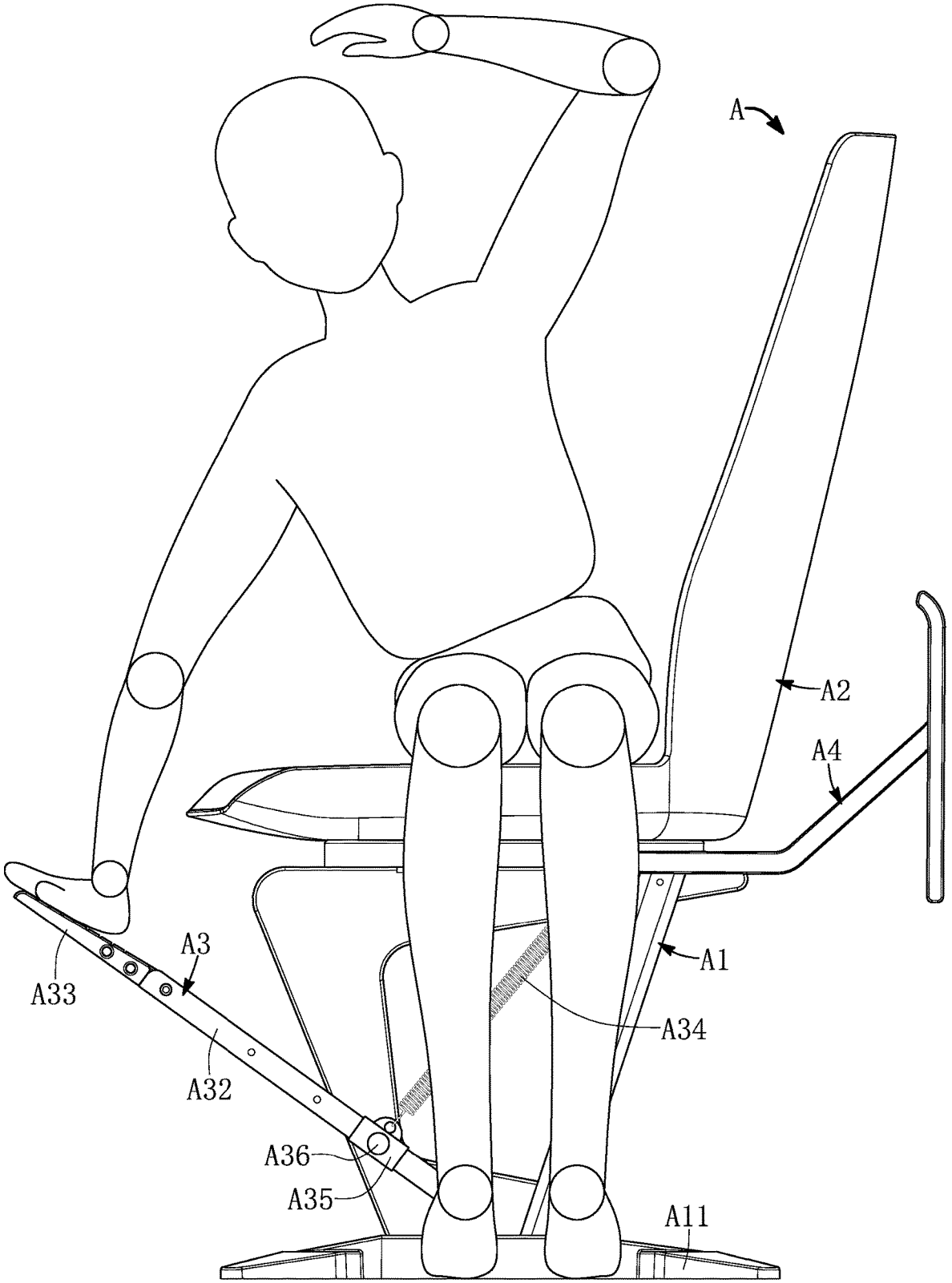
FIG. 21 is another schematic side view of the user exercising using the multifunctional chair provided by the present disclosure.

Referring to FIG. 13 and FIG. 21 together, FIG. 21 is another schematic side view of the user exercising using the multifunctional chair provided by the present disclosure. In practical applications, the multifunctional chair A may also include two armrest structures A4, which are movably connected to the support body A1, and each armrest structure A4 can be operated to rotate at least 90 degrees toward or away from the backrest structure A21. When the two armrest structures A4 are operated to rotate 90 degrees in the direction close to the backrest structure A21, the user can sit sideways on the multifunctional chair A, and one of the hands of the user can press one of the operating elements A33 for exercise.

Figure 22:
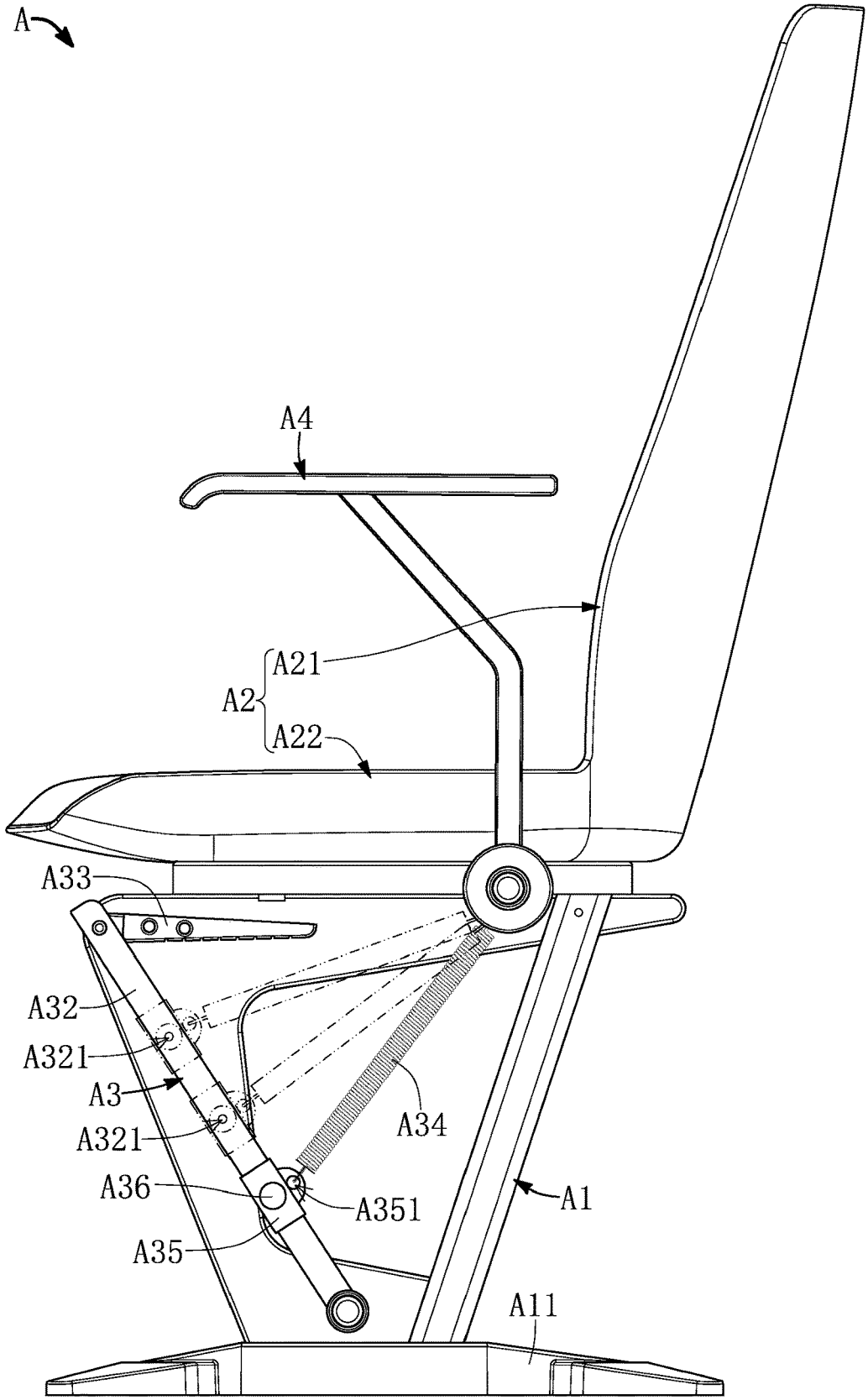
FIG. 22 is a schematic side view of the multifunctional chair including a plurality of elastic resistance elements arranged in different positions according to the present disclosure.
Figure 23:
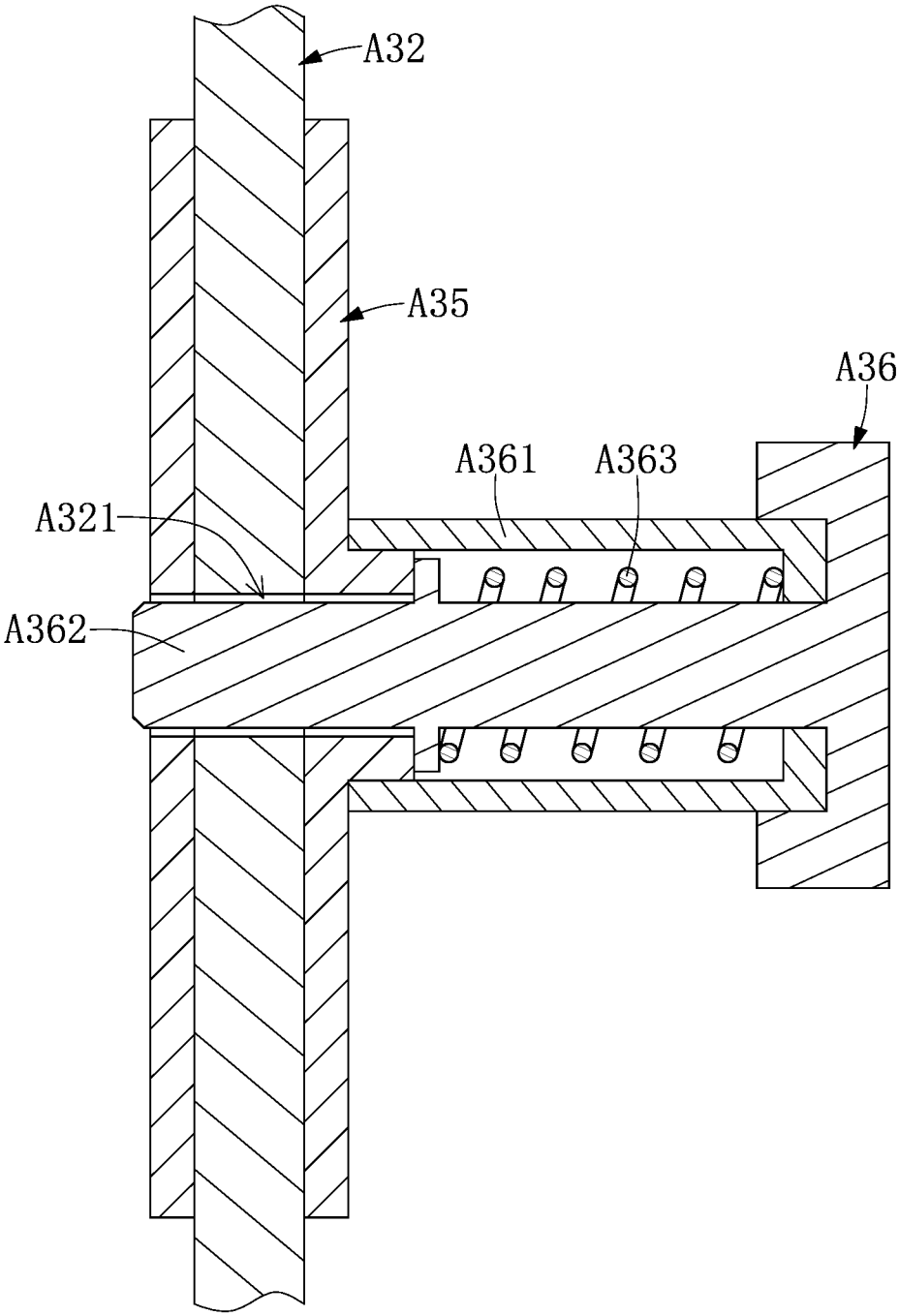
FIG. 23 is a schematic cross-sectional view of a spring latch and an outer fixing rod of the multifunctional chair provided by the present disclosure.

Referring to FIG. 13, FIG. 15, FIG. 22 and FIG. 23 together, FIG. 22 is a schematic side view of the elastic resistance elements of the multifunctional chair provided by the present disclosure in different positions, and FIG. 23 is a schematic cross-sectional view of the spring latch and the outer fixing rod of the multifunctional chair provided by the present disclosure. Each pedal assembly A3 also includes an auxiliary sleeve A35 and a spring latch A36 (or a spring pull pin), each outer fixing rod A32 includes a plurality of through holes A321, each outer fixing rod A32 is provided with the auxiliary sleeve A35, and the auxiliary sleeve A35 is sleeved around (or disposed around) the outer fixing rod A32. The auxiliary sleeve A35 can be, for example, a hollow structure. The auxiliary sleeve A35 has a fixing structure A351, and one end of the elastic resistance element A34 is connected with the fixing structure A351 of the auxiliary sleeve A35. The spring latch A36 is disposed on the auxiliary sleeve A35. The spring latch A36 includes a casing A361, a pin A362 (or bolt, latch or plug) and a spring A363. The pin A362 passes through and is disposed in the casing A361, one end of the spring A363 is fixed to the casing A361, and the other end of the spring A363 is fixed to the pin A362. The casing A361 can be fixed to the auxiliary sleeve A35, for example, through structures such as threads.

When the user does not operate the spring latch A36, one end of the pin A362 can correspondingly pass through one of the through holes A321 of the outer fixing rod A32, and the auxiliary sleeve A35 cannot move relative to the outer fixing rod A32. When the user operates the spring latch A36 to make the latch A362 move relative to the casing A361 and leave the through hole A321 (that is to say, the latch A362 can move away from the through hole A321), the auxiliary sleeve A35 will be able to move relative to the outer fixing rod A32, and at the same time, the spring A363 will be compressed to generate elastic resilience. When the user operates the spring latch A36 and makes the auxiliary sleeve A35 move from one of the through holes A321 to the other through hole A321 relative to the outer fixing rod A32, the user only needs to loosen the spring pull pin A36, and the spring A363 will drive the pin A362 to pass through the adjacent through hole A321 through the elastic recovery force generated by the compression of spring A363. It should be noted that the specific components included in the spring latch A36 and the connection relationship between the specific components are not limited to what is shown in the figures.

By setting the spring latch A36 on the outer fixing rod A32, the user can simply operate the spring latch A36 to fix one end of one of the elastic resistance elements A34 to different positions of the outer fixing rod A32. Thereby, the resistance provided by the elastic resistance element A34 can be adjusted when the outer fixing rod A32 rotates relative to the support body A1.

Figure 24:
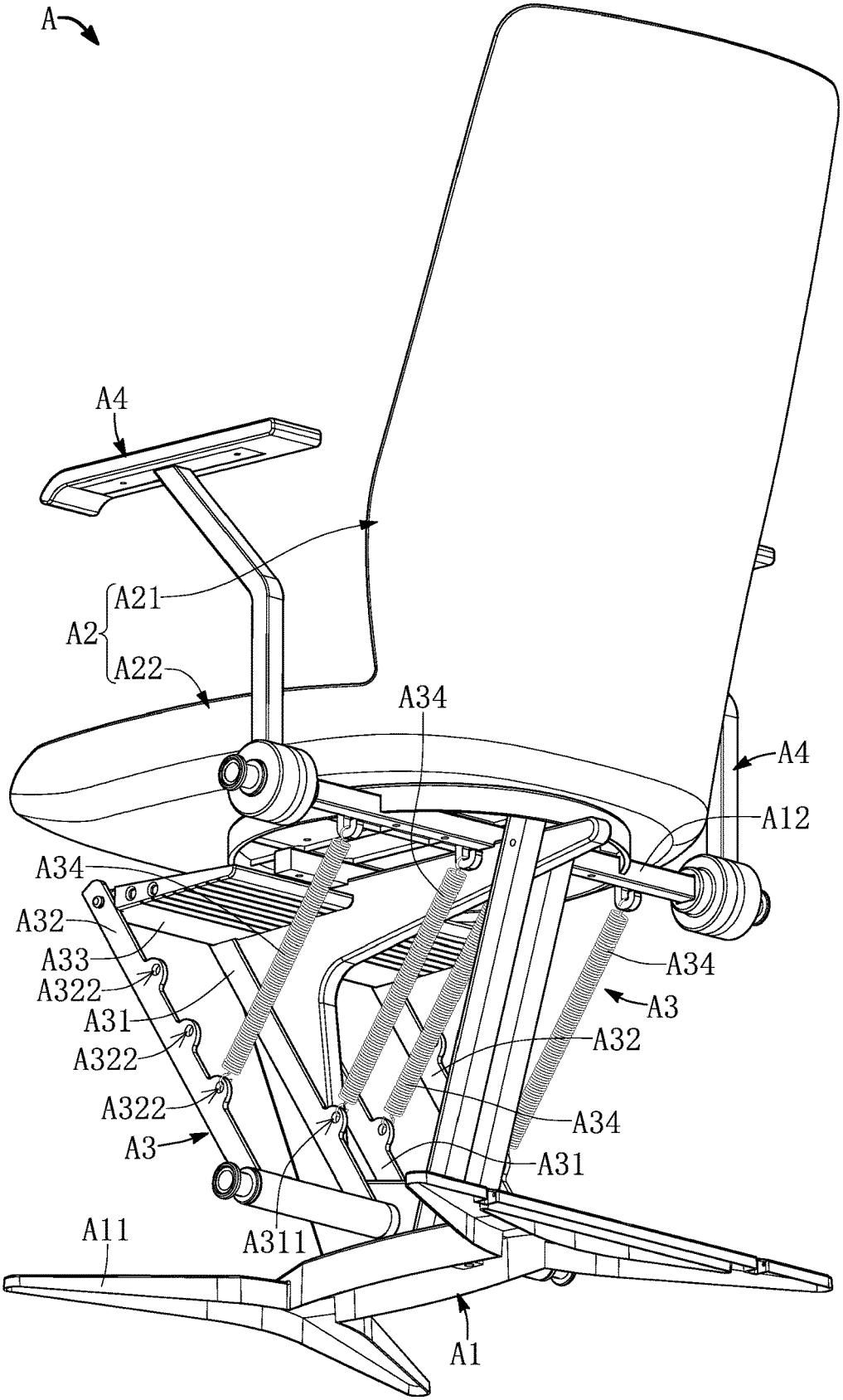
FIG. 24 is a schematic view of the multifunctional chair provided by yet another embodiment of the present disclosure.

Referring to FIG. 24, FIG. 24 is a schematic view of the multifunctional chair provided by another embodiment of the present disclosure. The biggest difference between the multifunctional chair of this embodiment and the preceding embodiments is that each outer fixing rod A32 is not provided with a spring latch, and each outer fixing rod A32 is provided with a plurality of fixing structures A322, and one end of the elastic resistance element A34 can be detachably connected with any one of the fixing structures A322 of the outer fixing rod A32. That is to say, in practical applications, relevant users can connect one end of the elastic resistance element A34 to any one of the fixing structures A322 of the outer fixing rod A32 according to actual needs. Thereby, the elastic restoring force generated when one end of the elastic resistance element A34 moves with the outer fixing rod A32 can be changed.

To sum up, the multifunctional chair provided by the present disclosure can not only be used as a general office chair, but also allow users to use the multifunctional chair to exercise through simple operations.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A multifunctional chair, comprising:

a support body including a placing part configured to be placed on a ground;

a seat body fixed to a fixed part of the support body; and at least one pedal assembly including:

at least one fixing rod, wherein one end of the at least one fixing rod is pivotally connected to the support body;

at least one operating element, wherein the at least one operating element is pivotally connected to another end of the at least one fixing rod, and the operating element is configured to be rotated relative to the at least one fixing rod and switched between a storage position and a support position; wherein, when the operating element is configured to be located at the storage position, the operating element does not protrude from a front edge of the seat body; wherein, when the operating element is configured to be located at the support position, the operating element and the at least one fixing rod are engaged with each other, and the operating element protrudes from the front edge of the seat body; and at least one elastic resistance element, wherein two ends of the at least one elastic resistance element are respectively fixed to the support body and the at least one fixing rod;

wherein the operating element located at the support position is configured to be operated to make the at least one fixing rod rotate relative to the support body, so that the elastic resistance element is configured to provide an elastic resistance;

wherein the operating element located at the support position is configured to be pressed by feet, a left hand or a right hand of a user sitting on the seat body.

2. The multifunctional chair according to claim 1, wherein the multifunctional chair includes two pedal assemblies, and each of the pedal assemblies is configured to be movable independently of another one of the pedal assemblies and relative to the support body.

3. The multifunctional chair according to claim 2, wherein each of the two pedal assemblies includes two fixing rods and two elastic resistance elements, the operating element and one end of each of the two fixing rods are pivotally connected to each other, and the operating element is configured to be rotated relative to the two fixing rods; wherein one end of one of the two elastic resistance elements is connected with one of the two fixing rods, and one end of another one of the two elastic resistance elements is connected with another one of the two fixing rods, and another end of each of the two elastic resistance elements is connected with the support body.

4. The multifunctional chair according to claim 3, wherein the end of each elastic resistance element and a fixing structure of one of the two fixing rods is detachably connected with each other, and the another end of each elastic resistance element is detachably connected to the support body.

5. The multifunctional chair according to claim 4, wherein the two fixing rods included in each of the two pedal assemblies are respectively defined as an outer fixing rod and an inner fixing rod, and the two inner fixing rods respectively included in the two pedal assemblies are arranged adjacent to each other, the outer fixing rod includes a plurality of fixing structures, and the one end of the elastic resistance element and any one of the fixing structures of the outer fixing rod are detachably connected with each other.

6. The multifunctional chair according to claim 4, wherein each of the two pedal assemblies further includes an auxiliary sleeve and a spring latch, the two fixing rods included in each of the two pedal assemblies are respectively defined as an inner fixing rod and an outer fixing rod, the outer fixing rod includes a plurality of through holes, the outer fixing rod is provided with the auxiliary sleeve, the auxiliary sleeve is sleeved around the outer fixing rod, the auxiliary sleeve has the fixing structure, and the spring latch is disposed on the auxiliary sleeve; wherein the spring latch is configured to make a pin of the spring latch pass through or leave an adjacent one of the through holes; wherein, when the spring latch is configured to make the pin leave the adjacent through hole, the auxiliary sleeve and the spring latch move relative to the outer fixing rod; wherein, when the pin is inserted into one of the through holes, the auxiliary sleeve is unable to move relative to the outer fixing rod.

7. The multifunctional chair according to claim 1, wherein the multifunctional chair further includes two armrest structures, the seat body includes a seat plate structure and a backrest structure, a rear edge of the seat plate structure and the backrest structure are connected with each other, the two armrest structures are movably connected to the support body, and each of the armrest structures is configured to be rotated at least 90 degrees toward or away from the backrest structure.

8. The multifunctional chair according to claim 1, wherein the at least one operating element includes a first position-limiting portion and a second position-limiting portion, the first position-limiting portion and the second position-limiting portion are adjacent to a position where the at least one operating element and the at least one fixing rod are pivotally connected to each other; wherein, when the at least one operating element is at the storage position, the first position-limiting portion abuts against the at least one fixing rod to limit a movable range of the at least one operating element relative to the at least one fixing rod; wherein, when the at least one operating element is at the support position, the second position-limiting portion abuts against the at least one fixing rod to limit the movable range of the at least one operating element relative to the at least one fixing rod.

* * * * *